US007393095B2

(12) United States Patent
Oshima et al.

(10) Patent No.: US 7,393,095 B2
(45) Date of Patent: Jul. 1, 2008

(54) INK JET RECORDING APPARATUS AND INK JET RECORDING METHOD

(75) Inventors: Kenji Oshima, Fukuoka (JP); Shigeyuki Takao, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 297 days.

(21) Appl. No.: 10/533,562

(22) PCT Filed: Oct. 1, 2004

(86) PCT No.: PCT/JP2004/014907

§ 371 (c)(1),
(2), (4) Date: May 3, 2005

(87) PCT Pub. No.: WO2005/032827

PCT Pub. Date: Apr. 14, 2005

(65) Prior Publication Data

US 2006/0007290 A1 Jan. 12, 2006

(30) Foreign Application Priority Data

Oct. 2, 2003 (JP) ..... 2003-344154

(51) Int. Cl.
*B41J 2/01* (2006.01)

(52) U.S. Cl. ..... 347/102; 347/101

(58) Field of Classification Search ..... 347/102, 347/101

See application file for complete search history.

(56) References Cited

U.S. PATENT DOCUMENTS

| | | | | |
|---|---|---|---|---|
| 5,745,222 | A * | 4/1998 | Kameda et al. | 355/72 |
| 6,783,227 | B2 * | 8/2004 | Suzuki et al. | 347/102 |
| 2002/0149660 | A1 | 10/2002 | Cleary et al. | |
| 2003/0035037 | A1 | 2/2003 | Mills et al. | |
| 2003/0081096 | A1 | 5/2003 | Young | |
| 2003/0184632 | A1 | 10/2003 | Suzuki et al. | |
| 2004/0263545 | A1 | 12/2004 | Esaki et al. | |
| 2005/0052483 | A1 | 3/2005 | Esaki et al. | |

FOREIGN PATENT DOCUMENTS

EP 1348566 10/2003

(Continued)

OTHER PUBLICATIONS

English language Abstract of JP 2002-137375.

(Continued)

*Primary Examiner*—Manish S Shah
(74) *Attorney, Agent, or Firm*—Greenblum & Berstein, P.L.C.

(57) ABSTRACT

An ink jet recording apparatus in which a UV curable ink is ejected from nozzle holes of an ink jet head. The ejected ink is attached onto a recording surface of a recording medium (recording paper), and is cured by irradiation with ultraviolet light. The ink jet head, or a moving member which moves together with the ink jet head, is provided with a plurality of ultraviolet light emitting diodes that emit the ultraviolet light to the ink attached onto the recording surface of the recording medium to cure the ink.

10 Claims, 9 Drawing Sheets

FOREIGN PATENT DOCUMENTS

| | | |
|---|---|---|
| JP | 2002-137375 | 5/2002 |
| JP | 2003-11334 | 1/2003 |
| JP | 2003-11343 | 1/2003 |
| JP | 2003-127338 | 5/2003 |
| JP | 2004-001437 | 1/2004 |

OTHER PUBLICATIONS

English language Abstract of JP 2003-11334.
English language Abstract of JP 2003-11343.
English language Abstract of JP 2003-127338.
English language Abstract of JP 2004-001437.

* cited by examiner

INK JET RECORDING APPARATUS AND INK JET RECORDING METHOD

TECHNICAL FIELD

The present invention relates to ink jet recording apparatuses and ink jet recording methods in which a photocurable ink (a UV curable ink, in particular) is ejected from nozzle holes of an ink jet head.

BACKGROUND ART

A technique has been conventionally known, in which a UV-curable ink is ejected from nozzle holes of an ink jet head onto the recording surface of a recording medium, and the ink attached to the recording surface is cured by ultraviolet irradiation so as to prevent the ink from spreading and bleeding on the recording surface (see Japanese Laid-Open Publication Nos. 2002-137375, 2003-11334, 2003-11343, and 2003-127338, for example).

As light sources of the ultraviolet light, discharge lamps such as mercury lamps and metal halide lamps are typically used. Such discharge lamps are attached to the ink jet head, so that ultraviolet light emitted by the discharge lamps is directly applied to the recording surface of a recording medium, as disclosed in the above-mentioned Japanese Laid-Open Publication Nos. 2003-11334 and 2003-11343. Alternatively, as disclosed in the above-mentioned Japanese Laid-Open Publication Nos. 2002-137375 and 2003-127338, ultraviolet light emitted by discharge lamps is guided through optical fibers to the ink jet head, from which the ultraviolet light is applied to the recording surface of a recording medium.

However, in the conventional examples, in which the ink is cured by the discharge lamps, the distribution of the illumination of the ultraviolet light emitted by the discharge lamps varies significantly on the recording surface of the recording medium. The ink curing rate thus changes from place to place, which may cause the resulting print density to differ between portions where the ink curing rate is high and portions where it is low.

In the cases where the discharge lamps are attached to the ink jet head, the ink jet head increases in size, such that high speed driving of the ink jet head becomes impossible. To enable the high speed driving, a larger driving apparatus is required. This, together with the increased size of the ink jet head, results in an increase in the size of the entire recording apparatus.

Also, the structure in which the discharge lamps and the ink jet head are connected via the optical fibers is indeed difficult to realize, because the optical fibers are made of quartz which is vulnerable to bending. Even if such a structure is obtained, the distance between the discharge lamps and the ink jet head has to be increased very much, which consequently increases the size of the entire recording apparatus.

Furthermore, discharge lamps have a relatively short life, their maintainability is poor, and their power consumption is large. In addition, discharge lamps take a long time to emit ultraviolet light in a stable manner. Thus, certain warm-up time is necessary after the lamps are operated, and even when the lamps do not have to be operated, such as when a recording medium is being carried, the lamps have to remain on.

DISCLOSURE OF INVENTION

In view of the above problems, the present invention has been made, and an object thereof is that when a photocurable ink such as the above-mentioned UV curable ink is ejected from nozzle holes of an ink jet head onto the recording surface of a recording medium and the ink attached onto the recording surface is cured by irradiation with ultraviolet light or other light, distribution of the light illumination on the recording surface is uniformalized to avoid inconsistencies in density, while preventing increase in the size of the recording apparatus, and in addition, improvements in maintainability and power savings are achieved.

To achieve the above object, in the present invention, the photocurable ink is cured by light emitters such as ultraviolet light emitting diodes.

More specifically, a first invention is applicable to an ink jet recording apparatus which includes an ink jet head whose recording-medium opposing surface that opposes a recording surface of a recording medium is furnished with an ink ejecting portion formed with open ends of a plurality of nozzle holes for ejecting a UV curable ink, and a head moving mechanism for putting the ink jet head into reciprocating motion in a predetermined direction parallel to the recording surface of the recording medium, and which performs recording by ejecting the ink from the nozzle holes of the ink jet head onto the recording surface of the recording medium and then curing the ink ejected and attached onto the recording surface of the recording medium by irradiation with ultraviolet light, at least when the head moving mechanism puts the ink jet head into a forward motion of the reciprocating motion.

And the ink jet head or a moving member which moves together with the ink jet head is provided with a plurality of ultraviolet light emitting diodes for emitting the ultraviolet light to the ink attached onto the recording surface of the recording medium to cure the ink.

The above configuration allows the ultraviolet light emitting diodes to be disposed in large numbers without causing an increase in the size of the ink jet head or the moving member, because the ultraviolet light emitting diodes are much smaller than discharge lamps. Thus, the distribution of the illumination of ultraviolet light on the recording surface is uniformalized, thereby preventing inconsistencies in density. Furthermore, since the ultraviolet light emitting diodes are disposed in vicinity to the recording surface of the recording medium, ink on the recording surface is cured to a sufficient degree that spreading and bleeding of the ink does not occur, even with the ultraviolet light emitting diodes whose emission intensity is lower than that of discharge lamps. Moreover, the ultraviolet light emitting diodes, which have a longer life and better responsiveness than discharge lamps, enhance maintainability. And power savings are also achieved by putting the ultraviolet light emitting diodes into a non light-emitting state when they do not have to emit light, combined with the fact that their power consumption is small.

According to a second invention, in the first invention the ultraviolet light emitting diodes, when seen from a direction perpendicular to the recording surface of the recording medium, are arranged to form one or a plurality of linear rows that extend in a direction perpendicular to the direction of the reciprocating motion of the ink jet head.

Then, a portion of the recording surface of the recording medium on which recording is performed in a single forward motion of the ink jet head is entirely irradiated with ultraviolet light during the single forward motion, while the distribution of the ultraviolet light illumination on that recording portion is uniformalized in the direction perpendicular to the direction of the reciprocating motion of the ink jet head (i.e., the direction of the ultraviolet-light-emitting-diode rows) so as to avoid inconsistencies in density.

According to a third invention, in the second invention the ultraviolet light emitting diodes form the plurality of rows.

Then, ink on the recording surface of the recording medium is reliably cured so as to avoid spreading and bleeding of the ink.

According to a fourth invention, in the third invention each ultraviolet light emitting diode in each ultraviolet-light-emitting-diode row is disposed in a position corresponding to the middle position between two adjacent ultraviolet light emitting diodes arranged in a neighboring one of the ultraviolet-light-emitting-diode rows, so that the ultraviolet light emitting diodes in the two adjoining ultraviolet-light-emitting-diode rows form a zigzag pattern.

If the ultraviolet light emitting diodes are arranged in a single row, difference in illumination of ultraviolet light is inevitably produced on the recording surface of the recording medium between a portion which corresponds to the middle position between any two adjacent ultraviolet light emitting diodes in the ultraviolet-light-emitting-diode row and portions which correspond to the positions of those two ultraviolet light emitting diodes. However, in this invention, the positions of the ultraviolet light emitting diodes in the adjoining ultraviolet-light-emitting-diode rows are displaced from each other, such that the illumination of ultraviolet light on the recording surface of the recording medium is further uniformalized in the direction of the ultraviolet-light-emitting-diode rows.

According to a fifth invention, in the second invention the open ends of the nozzle holes are arranged in the ink ejecting portion to form at least one or a plurality of linear rows that extend in a direction perpendicular to the direction of the reciprocating motion of the ink jet head, and the number of the ultraviolet light emitting diodes arranged in each ultraviolet-light-emitting-diode row is smaller than the number of the nozzle hole open ends existing in each nozzle-hole-open-end row.

This permits the number of nozzle holes to be maximized so as to increase recording density. And even if the number of ultraviolet light emitting diodes is smaller than that of nozzle hole open ends, it is possible to sufficiently uniformalize, in the direction of the ultraviolet-light-emitting-diode rows, the distribution of ultraviolet light illumination in a portion of the recording surface of the recording medium on which recording is performed in a single forward motion of the ink jet head.

According to a sixth invention, in the second invention the open ends of the nozzle holes are arranged in the ink ejecting portion to form at least one or a plurality of linear rows that extend in a direction perpendicular to the direction of the reciprocating motion of the ink jet head, and the ultraviolet light emitting diodes existing on both ends of each ultraviolet-light-emitting-diode row are positioned outwardly of the nozzle hole open ends existing on both ends of each nozzle-hole-open-end row with respect to the direction of the nozzle-hole-open-end row.

According to a seventh invention, in the second invention the length, in the direction of the ultraviolet-light-emitting-diode rows, of a portion of the recording surface of the recording medium on which recording is performed in a single forward motion of the ink jet head is smaller than the length, in the direction of the ultraviolet-light-emitting-diode rows, of a portion of the recording surface of the recording medium which can be irradiated with ultraviolet light emitted from all of the ultraviolet light emitting diodes during the single forward motion.

The sixth invention and the seventh invention ensure that a portion of the recording surface of the recording medium on which recording is performed in a single forward motion of the ink jet head is entirely irradiated with ultraviolet light during the single forward motion.

According to an eighth invention, in the second invention a pattern mask is provided between the ultraviolet light emitting diodes and the recording medium so as to reduce difference in illumination of ultraviolet light on the recording surface of the recording medium between a portion of the recording surface which corresponds to the middle position between any two adjacent ultraviolet light emitting diodes in each ultraviolet-light-emitting-diode row and portions of the recording surface which correspond to the positions of those two ultraviolet light emitting diodes.

This enables further uniformalization of the distribution of ultraviolet light illumination on the recording surface of the recording medium in the direction of the ultraviolet-light-emitting-diode rows.

According to a ninth invention, in the first invention the apparatus is configured so that the ultraviolet light emitted from the ultraviolet light emitting diodes is applied via a light guiding member to the ink attached to the recording medium.

This increases flexibility in disposing the ultraviolet light emitting diodes, while enabling the ultraviolet light to be applied flatly and substantially uniformly from the light guiding member, allowing the uniform distribution of the ultraviolet light illumination on the recording surface of the recording medium.

According to a tenth invention, in the first invention the apparatus is configured so that each time the ink jet head performs a forward motion and a backward motion of the reciprocating motion, the ink is ejected from the nozzle holes of the ink jet head onto the recording surface of the recording medium so as to perform recording, and the ultraviolet light emitting diodes are disposed at both sides of the ink ejecting portion with respect to the direction of the reciprocating motion of the ink jet head.

Then, irrespective of whether the ink jet head performs a forward motion or a backward motion, all of the ink is cured immediately after the ink has been attached onto the recording surface of the recording medium. More specifically, just after the ink is attached onto the recording surface of the recording medium, the ultraviolet light emitting diodes rearward of the ink ejecting portion with respect to the moving direction of the ink jet head (the rearward position with respect to the moving direction of the ink jet head differs depending on whether the ink jet head performs a forward or backward motion) are located opposing the attached ink. Therefore, the ink is easily cured by those ultraviolet light emitting diodes, immediately after the ink is attached onto the recording surface of the recording medium.

According to an eleventh invention, in the tenth invention the apparatus is configured so that in each of the forward and backward motions of the ink jet head, at least the ultraviolet light emitting diodes rearward of the ink ejecting portion with respect to the moving direction of the ink jet head emit the ultraviolet light.

Then, immediately after ink is attached onto the recording surface of the recording medium, the ultraviolet light emitting diodes rearward of the ink ejecting portion with respect to the moving direction of the ink jet head cure all of the ink, while it is possible to achieve power savings by making the ultraviolet light emitting diodes located frontward with respect to the moving direction stop emitting light.

According to a twelfth invention, in the first invention the apparatus is configured so that only when the ink jet head performs a forward motion of the reciprocating motion, the ink is ejected from the nozzle holes of the ink jet head onto the recording surface of the recording medium so as to perform recording, and the ultraviolet light emitting diodes are disposed rearward of the ink ejecting portion with respect to the direction of the forward motion of the ink jet head.

This minimizes the number of ultraviolet light emitting diodes, thereby reducing costs.

According to a thirteenth invention, in the first invention the nozzle holes are formed in a nozzle plate which forms the recording medium opposing surface of the ink jet head, and the ultraviolet light emitting diodes are disposed on the nozzle plate.

This invention permits the ultraviolet light emitting diodes to be disposed in vicinity to the recording surface of the recording medium.

According to a fourteenth invention, in the first invention the nozzle holes are formed in a nozzle plate which forms the recording medium opposing surface of the ink jet head, and the ultraviolet light emitting diodes are disposed on a member other than the nozzle plate.

Then, ink is less likely to be attached onto the ultraviolet light emitting diodes, while procedure for replacing the ultraviolet light emitting diodes with new ones is facilitated.

According to a fifteenth invention, in the first invention the apparatus is configured so that the ultraviolet light emitting diodes are placed in a case and that the ultraviolet light is emitted through a surface of the case.

This enables the many ultraviolet light emitting diodes to function as a unit, which improves the assemblability of the ultraviolet light emitting diodes onto the ink jet head or other members. In addition, direct adhesion of ink onto the ultraviolet light emitting diodes is also prevented.

According to a sixteenth invention, in the fifteenth invention the case is disposed so that the ultraviolet light emitting surface thereof is in the same plane as the recording medium opposing surface of the ink jet head.

This permits a blade for removing ink attached onto the recording-medium opposing surface to easily wipe off ink attached onto the ultraviolet light emitting surface of the case.

According to a seventeenth invention, in the fifteenth invention the case is disposed so that the ultraviolet light emitting surface thereof is located closer to the recording medium than the recording medium opposing surface of the ink jet head is.

Then, ink on the recording surface is reliably cured even with the ultraviolet light emitting diodes having relatively low emission intensity.

According to a eighteenth invention, in the fifteenth invention the case is disposed so that the ultraviolet light emitting surface thereof is located farther from the recording medium than the recording medium opposing surface of the ink jet head is.

Then, ink is hardly attached onto the ultraviolet light emitting surface of the case.

According to a nineteenth invention, in the fifteenth invention the case is disposed at least rearward of the ink ejecting portion with respect to the direction of the forward motion of the ink jet head, and the ultraviolet light emitting surface of the case is tilted with respect to the recording medium opposing surface of the ink jet head so that the side of the ultraviolet light emitting surface closer to the ink ejecting portion is located closer to the recording medium than the opposite side of the case is.

Then, adhesion of ink on the ultraviolet light emitting surface of the case is prevented more reliably, while it is also possible to prevent part of the ultraviolet light from reaching ink that remains in the nozzle hole open ends to cause curing of the ink and the resulting clogging.

According to a twentieth invention, in the fifteenth invention the case is disposed at least rearward of the ink ejecting portion with respect to the direction of the forward motion of the ink jet head, and a light blocking member for preventing part of the ultraviolet light emitted by the ultraviolet light emitting diodes from reaching the ink ejecting portion is provided between the case and the ink ejecting portion.

This invention prevents ink remaining in the nozzle hole open ends from being cured to cause clogging, while reliably preventing adhesion of ink on the ultraviolet light emitting surface of the case.

According to a twenty-first invention, in the first invention a heat conduction member for conducting, to the ink within the ink jet head, heat produced by the emission by the ultraviolet light emitting diodes is provided.

Then, the temperature of the ink in the ink jet head can be raised so as to decrease the viscosity of the ink (UV curable inks have higher viscosity than typical inks), thereby improving the ink-ejection capability.

According to a twenty-second invention, in the first invention a radiator for dissipating heat produced by the emission by the ultraviolet light emitting diodes is provided.

This prevents cases in which due to heat generated by the ultraviolet light emitting diodes, the temperature of the ultraviolet light emitting diodes themselves are increased excessively to decrease the emission intensity thereof, or the temperature of the ink jet head is increased excessively to cause deformation of the nozzle plate or other members to disturb the ink ejection.

According to a twenty-third invention, in the first invention the ink jet recording apparatus further includes a recording medium moving mechanism for moving the recording medium in a direction perpendicular to the direction of the reciprocating motion of the ink jet head and parallel to the recording surface of the recording medium, and a discharge lamp disposed frontward of the ink jet head with respect to the moving direction of the recording medium and capable of applying ultraviolet light to an entire recording area of the recording surface of the recording medium with respect to the direction of the reciprocating motion of the ink jet head.

Then, with the ink jet head being moved, ink is ejected from the nozzle holes of the ink jet head and primary curing of the ink ejected and attached onto the recording surface of the recording medium is performed by the ultraviolet light emitting diodes. Subsequently, the recording medium is moved in the direction parallel to the recording surface of the recording medium and perpendicular to the direction of the reciprocating motion of the ink jet head, and secondary curing of the ink already subjected to the primary curing is performed by the discharge lamp in the entire recording area of the recording surface of the recording medium with respect to the direction of the reciprocating motion of the ink jet head. More specifically, immediately after the ink is attached onto the recording surface of the recording medium, the ink is half-cured by the ultraviolet light emitting diodes to a degree that no spreading or bleeding occurs, and then the ink already subjected to the primary curing is completely cured by the discharge lamp each time a single scanning has been completed or after all of the scannings have been completed. Consequently, all of the ink on the recording surface is reliably cured at the time all of the recording has been completed, even if the ultraviolet light emitting diodes having significantly low emission intensity are used.

A twenty-fourth invention is applicable to an ink jet recording apparatus which includes a recording medium moving mechanism for moving a recording medium in a predetermined direction parallel to a recording surface of the recording medium, and an ink jet head which extends in a direction perpendicular to the moving direction of the recording medium and parallel to the recording surface of the recording medium and whose recording-medium opposing surface that opposes the recording surface of the recording medium is furnished with an ink ejecting portion formed with open ends of a plurality of nozzle holes for ejecting a UV curable ink; and which performs recording by ejecting the ink from the nozzle holes of the ink jet head onto the recording surface of the recording medium and then curing the ink ejected and attached onto the recording surface of the recording medium by irradiation with ultraviolet light, with the recording medium being moved by the recording medium moving mechanism.

And the ink jet head or a member disposed in the vicinity of the ink jet head is provided with a plurality of ultraviolet light emitting diodes for emitting the ultraviolet light to the ink attached onto the recording surface of the recording medium to cure the ink.

This invention allows uniformalization of the distribution of ultraviolet light illumination on the recording surface of the recording medium so as to avoid inconsistencies in density, even in cases where the ink jet head is a so-called line head. Furthermore, the ink jet head or the member disposed in the vicinity of the ink jet head does not increase in size, and in addition, maintainability is enhanced, while power savings are achieved.

According to a twenty-fifth invention, in the twenty-fourth invention the ultraviolet light emitting diodes, when seen from a direction perpendicular to the recording surface of the recording medium, are arranged to form one or a plurality of linear rows that extend in the length direction of the ink jet head.

Then, when recording is performed with the recording medium being moved, ultraviolet light is applied to the entire recording area of the recording surface of the recording medium with respect to the length direction of the ink jet head, while the distribution of the ultraviolet light illumination on that recording area is uniformalized in the length direction of the ink jet head (i.e., the ultraviolet-light-emitting-diode-row direction) to avoid inconsistencies in density.

According to a twenty-sixth invention, in the twenty-fifth invention the ultraviolet light emitting diodes form the plurality of rows.

This provides the same effects as those obtainable by the third invention.

According to a twenty-seventh invention, in the twenty-sixth invention each ultraviolet light emitting diode in each ultraviolet-light-emitting-diode row is disposed in a position corresponding to the middle position between two adjacent ultraviolet light emitting diodes arranged in a neighboring one of the ultraviolet-light-emitting-diode rows, so that the ultraviolet light emitting diodes in the two adjoining ultraviolet-light-emitting-diode rows form a zigzag pattern.

Then, the same effects as those obtainable by the fourth invention are achieved.

According to a twenty-eighth invention, in the twenty-fifth invention the ultraviolet light emitting diodes existing on both ends of each ultraviolet-light-emitting-diode row are positioned outwardly, with respect to the length direction of the ink jet head, of ones of the nozzle hole open ends located in the endmost positions in the length direction of the ink jet head.

According to a twenty-ninth invention, in the twenty-fifth invention the length, in the direction of the ultraviolet-light-emitting-diode rows, of a portion of the recording surface of the recording medium which can be irradiated with ultraviolet light emitted from all of the ultraviolet light emitting diodes is greater than the length, in the direction of the ultraviolet-light-emitting-diode rows, of a portion of the recording surface of the recording medium on which recording is performed by the ink jet head.

According to the twenty-eighth invention and the twenty-ninth invention, when recording is performed with the recording medium being moved, ultraviolet light is reliably applied to the entire recording portion of the recording surface of the recording medium with respect to the length direction of the ink jet head.

According to a thirtieth invention, in the twenty-fifth invention a pattern mask is provided between the ultraviolet light emitting diodes and the recording medium so as to reduce difference in illumination of ultraviolet light on the recording surface of the recording medium between a portion of the recording surface which corresponds to the middle position between any two adjacent ultraviolet light emitting diodes in each ultraviolet-light-emitting-diode row and portions of the recording surface which correspond to the positions of those two ultraviolet light emitting diodes.

This provides the same effects as those obtainable by the eighth invention.

According to a thirty-first invention, in the twenty-fifth invention the apparatus is configured so that the ultraviolet light emitted from the ultraviolet light emitting diodes is applied via a light guiding member to the ink attached to the recording medium.

Then, the same effects as those obtainable by the ninth invention are achieved.

According to a thirty-second invention, in the twenty-fourth invention the ultraviolet light emitting diodes are disposed at least frontward of the ink ejecting portion with respect to the moving direction of the recording medium.

Then, immediately after ink is attached onto the recording surface of the recording medium, the ink is easily cured.

According to a thirty-third invention, in the twenty-fourth invention the nozzle holes are formed in a nozzle plate which forms the recording medium opposing surface of the ink jet head, and the ultraviolet light emitting diodes are disposed on the nozzle plate.

Then, the same effects as those obtainable by the thirteenth invention are achieved.

According to a thirty-fourth invention, in the twenty-fourth invention the nozzle holes are formed in a nozzle plate which forms the recording medium opposing surface of the ink jet head, and the ultraviolet light emitting diodes are disposed on a member other than the nozzle plate.

Then, the same effects as those obtainable by the fourteenth invention are achieved.

According to a thirty-fifth invention, in the twenty-fourth invention the apparatus is configured so that the ultraviolet light emitting diodes are placed in a case and that the ultraviolet light is emitted through a surface of the case.

Then, the same effects as those obtainable by the fifteenth invention are achieved.

According to a thirty-sixth invention, in the thirty-fifth invention the case is disposed so that the ultraviolet light emitting surface thereof is in the same plane as the recording medium opposing surface of the ink jet head.

Then, the same effects as those obtainable by the sixteenth invention are achieved.

According to a thirty-seventh invention, in the thirty-fifth invention the case is disposed so that the ultraviolet light emitting surface thereof is located closer to the recording medium than the recording medium opposing surface of the ink jet head is.

Then, the same effects as those obtainable by the seventeenth invention are achieved.

According to a thirty-eighth invention, in the thirty-fifth invention the case is disposed so that the ultraviolet light emitting surface thereof is located farther from the recording medium than the recording medium opposing surface of the ink jet head is.

Then, the same effects as those obtainable by the eighteenth invention are achieved.

According to a thirty-ninth invention, in the thirty-fifth invention the case is disposed at least frontward of the ink ejecting portion with respect to the moving direction of the recording medium, and the ultraviolet light emitting surface of the case is tilted with respect to the recording medium opposing surface of the ink jet head so that the side of the ultraviolet light emitting surface closer to the ink ejecting portion is located closer to the recording medium than the opposite side of the case is.

Then, the same effects as those obtainable by the nineteenth invention are achieved.

According to a fortieth invention, in the thirty-fifth invention the case is disposed at least frontward of the ink ejecting portion with respect to the moving direction of the recording medium, and a light blocking member for preventing part of the ultraviolet light emitted by the ultraviolet light emitting diodes from reaching the ink ejecting portion is provided between the case and the ink ejecting portion.

Then, the same effects as those obtainable by the twentieth invention are achieved.

According to a forty-first invention, in the twenty-fourth invention a heat conduction member for conducting, to the ink within the ink jet head, heat produced by the emission by the ultraviolet light emitting diodes is provided.

Then, the same effects as those obtainable by the twenty-first invention are achieved.

According to a forty-second invention, in the twenty-fourth invention a radiator for dissipating heat produced by the emission by the ultraviolet light emitting diodes is provided.

Then, the same effects as those obtainable by the twenty-second invention are achieved.

According to a forty-third invention, in the twenty-fourth invention the apparatus further includes a discharge lamp disposed frontward of the ink jet head with respect to the moving direction of the recording medium and capable of applying ultraviolet light to an entire recording area of the recording surface of the recording medium with respect to a direction perpendicular to the moving direction of the recording medium.

Then, with the recording medium being moved, the ink is ejected from the nozzle holes of the ink jet head and primary curing of the ink ejected and attached onto the recording surface of the recording medium is performed by the ultraviolet light emitting diodes. Subsequently, secondary curing of the ink already subjected to the primary curing is performed by the discharge lamp. More specifically, immediately after the ink is attached onto the recording surface of the recording medium, the ink is half-cured by the ultraviolet light emitting diodes to a degree that no spreading or bleeding occurs, and the recording medium as it is, is moved, after which the ink already subjected to the primary curing is completely cured by the discharge lamp. Consequently, all of the ink on the recording surface is reliably cured at the time all of the recording has been completed, even if the ultraviolet light emitting diodes having significantly low emission intensity are used.

A forty-fourth invention is applicable to an ink jet recording method, in which an ink jet head which ejects a UV curable ink from nozzle holes onto a recording surface of a recording medium and is capable of performing reciprocating motion in a predetermined direction parallel to the recording surface of the recording medium is used, and recording is performed by ejecting the ink from the nozzle holes onto the recording surface of the recording medium and then curing the ink ejected and attached onto the recording surface of the recording medium by irradiation with ultraviolet light, at least when the ink jet head performs a forward motion of the reciprocating motion.

And, with the ink jet head being moved, the ink is ejected from the nozzle holes of the ink jet head and primary curing of the ink ejected and attached onto the recording surface of the recording medium is performed by ultraviolet light emitting diodes provided on the ink jet head or a moving member which moves together with the ink jet head, and the recording medium is then moved in a direction perpendicular to the direction of the reciprocating motion of the ink jet head and parallel to the recording surface of the recording medium, and secondary curing of the ink already subjected to the primary curing is performed by a discharge lamp capable of applying ultraviolet light to an entire recording area of the recording surface of the recording medium with respect to the direction of the reciprocating motion of the ink jet head.

Then, the same effects as those obtainable by the twenty-third invention are achieved.

A forty-fifth invention is applicable to an ink jet recording method, in which an ink jet head, which ejects a UV curable ink from nozzle holes onto a recording surface of a recording medium capable of moving in a predetermined direction parallel to the recording surface and extends in a direction perpendicular to the moving direction of the recording medium, is used, and recording is performed by ejecting the ink from the nozzle holes of the ink jet head onto the recording surface of the recording medium and then curing the ink ejected and attached onto the recording surface of the recording medium by irradiation with ultraviolet light, with the recording medium being moved.

And, with the recording medium being moved, the ink is ejected from the nozzle holes of the ink jet head and primary curing of the ink ejected and attached onto the recording surface of the recording medium is performed by ultraviolet light emitting diodes provided on the ink jet head or a member disposed in the vicinity of the ink jet head, and secondary curing of the ink already subjected to the primary curing is performed by a discharge lamp capable of applying ultraviolet light to an entire recording area of the recording surface of the recording medium with respect to a direction perpendicular to the moving direction of the recording medium.

Then, the same effects as those obtainable by the forty-third invention are achieved.

A forty-sixth invention is applicable to an ink jet recording apparatus which includes an ink jet head whose recording-medium opposing surface that opposes a recording surface of a recording medium is furnished with an ink ejecting portion formed with open ends of a plurality of nozzle holes for ejecting a photocurable ink, and a head moving mechanism for putting the ink jet head into reciprocating motion in a predetermined direction parallel to the recording surface of the recording medium, and which performs recording by ejecting the ink from the nozzle holes of the ink jet head onto the recording surface of the recording medium and then curing the ink ejected and attached onto the recording surface of the recording medium by irradiation with light, at least when the head moving mechanism puts the ink jet head into a forward motion of the reciprocating motion.

And the ink jet head or a moving member which moves together with the ink jet head is provided with a plurality of light emitters for emitting the light to the ink attached onto the recording surface of the recording medium to cure the ink.

No matter what photocurable ink is employed, this invention enables the distribution of the illumination of light on the recording surface of the recording medium to be uniformalized so as to avoid inconsistencies in density, while preventing the recording apparatus to be increased in size, by using small-sized light emitters such as light emitting diodes which apply light that cures the photocurable ink employed. In addition, maintainability is enhanced and power savings are achieved.

According to a forty-seventh invention, in the forty-sixth invention the light emitters are ultraviolet light emitting diodes.

Then, when a UV curable ink is used, the same effects as those obtainable by the first invention are achieved.

According to a forty-eighth invention, in the forty-sixth invention the light emitters are light emitting diodes containing GaN.

Then, light emitting diodes, having high luminous efficacy, best suited to cure photocurable ink on the recording surface of the recording medium are easily obtained.

A forty-ninth invention is applicable to an ink jet recording apparatus which includes a recording medium moving mechanism for moving a recording medium in a predetermined direction parallel to a recording surface of the recording medium, and an ink jet head which extends in a direction perpendicular to the moving direction of the recording medium and parallel to the recording surface of the recording medium and whose recording-medium opposing surface that opposes the recording surface of the recording medium is furnished with an ink ejecting portion formed with open ends of a plurality of nozzle holes for ejecting a photocurable ink; and which performs recording by ejecting the ink from the nozzle holes of the ink jet head onto the recording surface of the recording medium and then curing the ink ejected and attached onto the recording surface of the recording medium by irradiation with light, with the recording medium being moved by the recording medium moving mechanism.

And the ink jet head or a member disposed in the vicinity of the ink jet head is provided with a plurality of light emitters for emitting the light to the ink attached onto the recording surface of the recording medium to cure the ink.

This invention provides the same effects as those obtainable by the forty-sixth invention even in cases where the ink jet head is a so-called line head.

According to a fiftieth invention, in the forty-ninth invention the light emitters are ultraviolet light emitting diodes.

Then, when a UV curable ink is used, the same effects as those obtainable by the twenty-forth invention are achieved.

According to a fifty-first invention, in the forty-ninth invention the light emitters are light emitting diodes containing GaN.

Then, the same effects as those obtainable by the forty-eighth invention are achieved.

BEST MODE FOR CARRYING OUT THE INVENTION

Embodiments of the present invention will be described in detail with reference to the accompanying drawings.

First Embodiment

Figure 1:
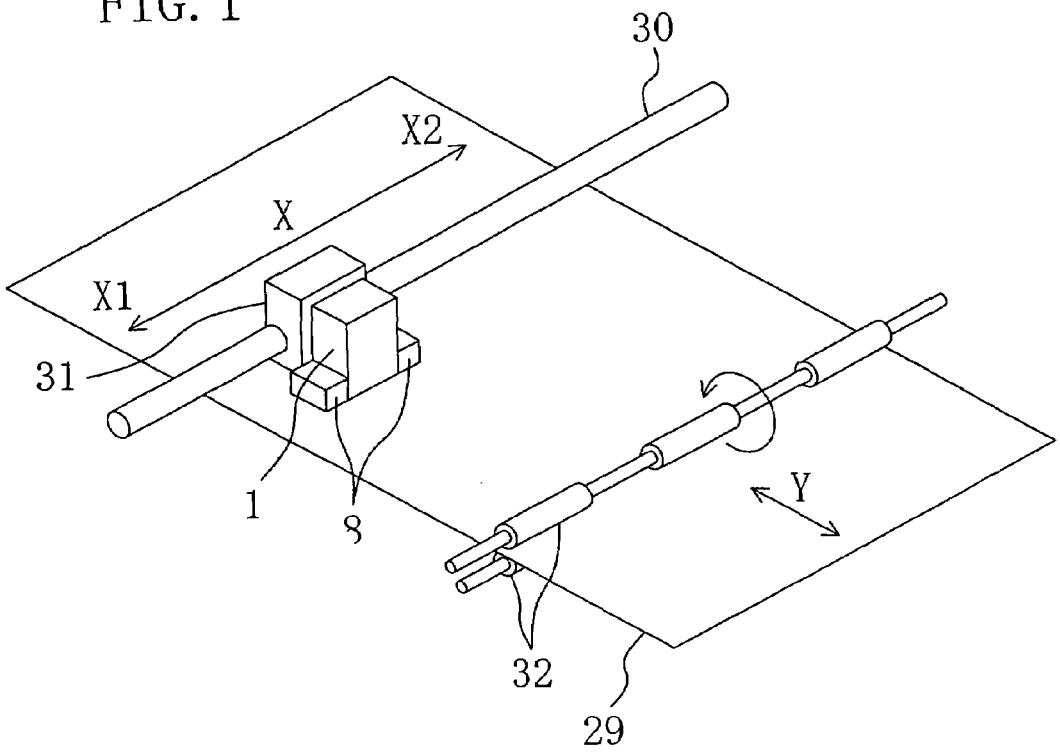
FIG. 1 is an oblique view schematically illustrating an ink jet recording apparatus according to a first embodiment of the present invention.

FIG. 1 schematically illustrates an ink jet recording apparatus according to a first embodiment of the present invention. The ink jet recording apparatus includes an ink jet head 1 which, as will be described later, ejects UV curable inks (photocurable inks) onto the recording surface (i.e., the upper surface) of a recording paper 29 serving as a recording medium. The ink jet head 1 is fixedly supported by a carriage 31, which is provided with a not-shown carriage motor. Being guided by a carriage shaft 30 that extends in the main scanning direction (i.e., the X direction shown in FIG. 1) parallel to the recording surface of the recording paper 29, the ink jet head 1 and the carriage 31 are reciprocated by the carriage motor in the main scanning direction between a position X1 that corresponds to one end of the width of the recording paper 29 and a position X2 that corresponds to the other end thereof. The carriage 31, the carriage shaft 30, and the carriage motor form a head moving mechanism for putting the ink jet head 1 into the reciprocating motion in the main scanning direction.

The recording paper 29 is interposed between two carrier rollers 32 which are rotated by a not-shown carrier motor. The carrier motor and the carrier rollers 32 move the recording paper 29 in the sub-scanning direction (i.e., the Y direction shown in FIG. 1) which is perpendicular to the main scanning direction and parallel to the recording surface of the recording paper 29. The carrier motor and the carrier rollers 32 form a recording-medium moving mechanism for moving the recording paper 29 in the sub-scanning direction.

Figure 2:
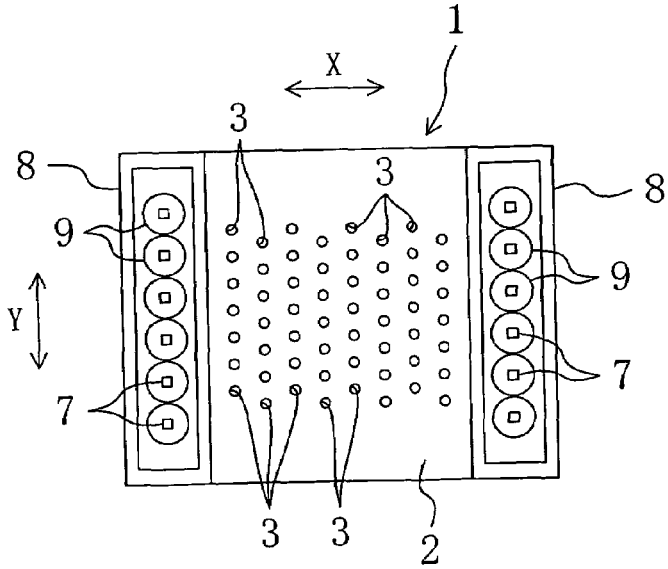
FIG. 2 is the bottom view of an ink jet head of the ink jet recording apparatus.

As shown in FIG. 2, a recording-medium opposing surface (i.e., the lower surface) of the ink jet head 1 that opposes the recording surface of the recording paper 29 is furnished with an ink ejecting portion 2 formed with the open ends of a plurality of nozzle holes 3 for ejecting the inks. The open ends of the nozzle holes 3 are arranged in the ink ejecting portion 2 to form eight linear rows extending in the sub-scanning direction. More specifically, the ink jet head 1 is designed to eject four color inks: yellow, magenta, cyan, and black. For each color, two rows of the nozzle-hole 3 open-ends are provided. The open end of each nozzle hole 3 arranged in each of the two nozzle-hole-open-end rows provided for each color is disposed in a position corresponding to the middle position between two adjacent nozzle-hole 3 open-ends arranged in the neighboring nozzle-hole-open-end row, so that the open ends of the nozzle holes 3 in the adjacent two rows form a zigzag pattern. It should be noted that a single nozzle-hole-open-end row may be provided for each color (which means that four rows are provided in total.) In a case where only a single color (e.g., black) ink is used, only a single row may be provided in total.

When the ink jet head 1 is moving from the position X1 corresponding to the one end of the width of the recording paper 29 to the position X2 corresponding to the other end thereof (i.e., when the ink jet head 1 is performing a forward motion), the inks are ejected from the nozzle holes 3 onto the recording surface of the recording paper 29 to perform recording. When the ink jet head 1 has reached the position X2 (i.e., when the recording in the single scanning has been completed), the recording paper 29 is moved toward one side (the front side in FIG. 1, in the first embodiment) in the sub-scanning direction, and this time the ink jet head 1 is moved from the position X2 toward the position X1 (which means that the ink jet head 1 is put into a backward motion.) During the backward motion, the inks are ejected from the nozzle holes 3 onto the recording surface of the recording paper 29 to perform recording as in the forward motion. When the ink jet head 1 has reached the position X1 (i.e., when the recording in this single scanning has been completed), the recording paper 29 is again moved toward the one side in the sub-scanning direction, so that the ink jet head 1 is again put into a forward motion. By repeating the above motions, recording is performed on substantially the entire recording surface of the recording paper 29. It should be noted that when the forward motion of the ink jet head 1 is completed, the recording paper 29 does not need to be moved, so that recording is performed on the same portion of the recording paper 29 in the forward motion and the subsequent backward motion. And when the forward motion and the subsequent backward motion have been completed, the recording paper 29 may be moved toward the one side in the sub-scanning direction.

The ink jet head 1 is furnished with a plurality of ultraviolet light emitting diodes 7 (light emitters) for applying ultraviolet light to ink attached onto the recording surface of the recording paper 29 to cure the ink. The ultraviolet light emitting diodes 7 emit ultraviolet light with a peak wavelength of 380 nm or smaller. Preferably, the ultraviolet light emitting diodes 7 have an optical output power of 10 mW or more, are hermetically sealed, and are surface-mounting devices. Furthermore, the ultraviolet light emitting diodes 7 are preferably light-emitting diodes containing GaN, in which case their luminous efficacy can be increased. Examples of ultraviolet light emitting diodes include ultraviolet light emitting LEDs and organic EL (electro luminescence) devices.

Figure 3:
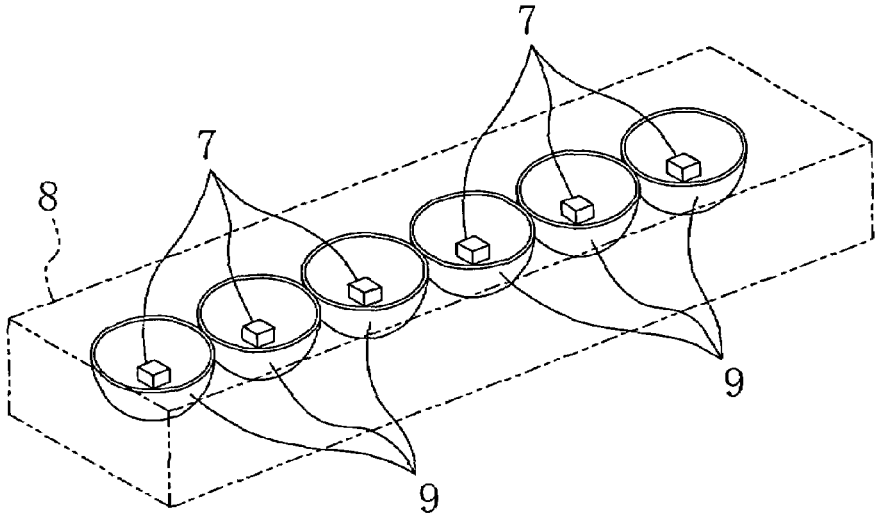
FIG. 3 is an oblique view illustrating ultraviolet light emitting diodes and reflecting plates in a unit case.

In the first embodiment, the ultraviolet light emitting diodes 7 are provided at each side of the ink ejecting portion 2 with respect to the main scanning direction. When viewed from the direction (the upward and downward direction) perpendicular to the recording surface of the recording paper 29, the ultraviolet light emitting diodes 7 at each side are arranged to form a linear row extending in the sub-scanning direction. As shown in FIG. 3, the ultraviolet light emitting diodes 7 at each side of the ink ejecting portion 2 are placed in a case 8 to form a unit. Ultraviolet light, reflected by bowl-shaped reflecting plates 9 provided in the respective locations of the ultraviolet light emitting diodes 7 in the unit case 8, is emitted through a surface (i.e., the upper surface shown in FIG. 3, only this surface is transparent) of the unit case 8.

Figure 4:
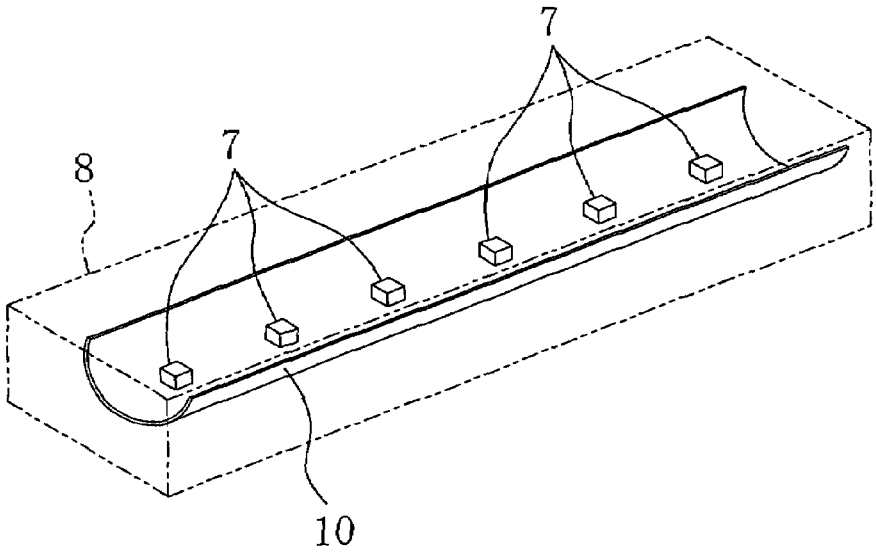
FIG. 4 is a view corresponding to FIG. 3 and indicating a case in which a half-pipe-shaped reflecting plate is employed.
Figure 5:
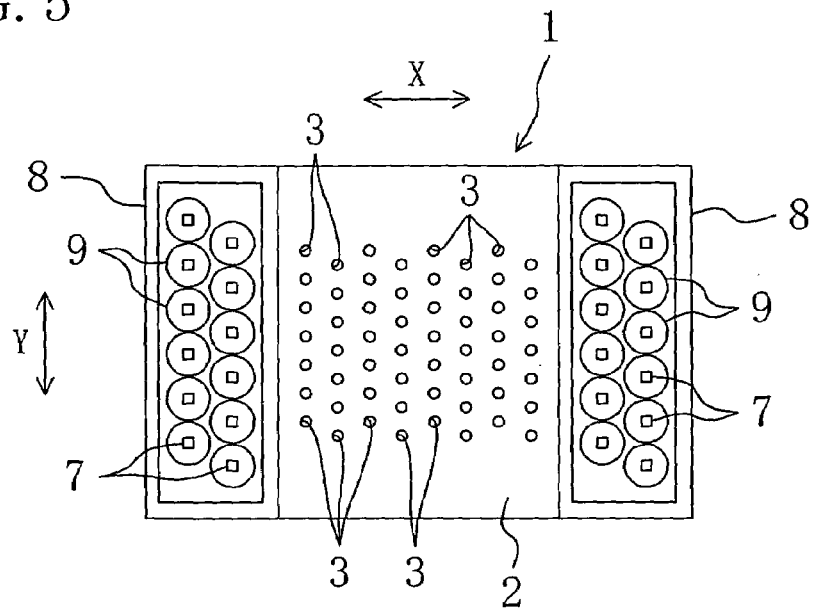
FIG. 5 is a view corresponding to FIG. 2 and indicating a case in which ultraviolet light emitting diodes are arranged forming a zigzag pattern.

Although in the first embodiment, the ultraviolet light emitting diodes 7 at each side of the ink ejecting portion 2 are placed in the single unit case 8, each ultraviolet light emitting diode 7 may be independently placed in a case. Furthermore, although in the first embodiment, the bowl-shaped reflecting plates 9 are provided in the respective locations of the ultraviolet light emitting diodes 7 in the unit case 8, a half-pipe-shaped reflecting plate 10 extending in the direction of the ultraviolet-light-emitting-diode row may be provided as shown in FIG. 4. Moreover, instead of providing the single ultraviolet-light-emitting-diode row, a plurality of ultraviolet-light-emitting-diode rows may be formed at each side of the ink ejecting portion 2. In that case, as in the case of the nozzle-hole-open-end rows, each of the ultraviolet light emitting diodes 7 in each ultraviolet-light-emitting-diode row may be disposed in a position corresponding to the middle position between two adjacent ultraviolet light emitting diodes 7 arranged in the neighboring ultraviolet-light-emitting-diode row(s), so that the ultraviolet light emitting diodes 7 in the adjacent two rows form a zigzag pattern, as shown in FIG. 5.

The unit cases 8 at both sides of the ink ejecting portion 2 with respect to the main scanning direction are disposed on both lateral faces of the ink jet head 1 with respect to the main scanning direction, so that the ultraviolet light emitting surface of each unit case 8 is in the same plane as the recording medium opposing surface of the ink jet head 1. This structure permits a blade for removing ink attached onto the recording-medium opposing surface of the ink jet head 1 to easily wipe off ink attached onto the ultraviolet light emitting surfaces of the cases.

It should be noted that the ultraviolet light emitting surfaces of the unit cases 8 do not necessarily have to be in the same plane as the recording-medium opposing surface of the ink jet head 1. The ultraviolet light emitting surfaces of the cases 8 may be located closer to the recording paper 29 than the recording-medium opposing surface of the ink jet head 1 is, or may be located farther from the recording paper 29 than the recording-medium opposing surface of the ink jet head 1 is. More specifically, considering the emission intensity of the ultraviolet light emitting diodes 7, the distance between the ultraviolet light emitting surface of each unit case 8 and the recording surface of the recording paper 29 may be from 0.3 mm to 15 mm (the distance between the recording-medium opposing surface of the ink jet head 1 and the recording surface of the recording paper 29 is from 0.5 mm to 10 mm.)

Figure 6:
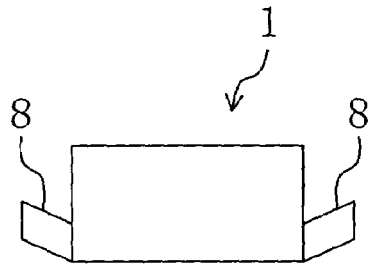
FIG. 6 is a view indicating a case in which the ultraviolet light emitting surfaces of unit cases are tilted, as seen from the sub-scanning direction of the ink jet head.

The ultraviolet light emitting surfaces of the unit cases 8 do not have to be parallel, but may be inclined, with respect to the recording surface of the recording paper 29. In that case, as shown in FIG. 6, the ultraviolet light emitting surface of each unit case 8 may be tilted with respect to the recording medium opposing surface of the ink jet head 1 so that the side of the ultraviolet light emitting surface closer to the ink ejecting portion 2 is located closer to the recording paper 29 than the opposite side of the unit case 8 is.

Figure 7:
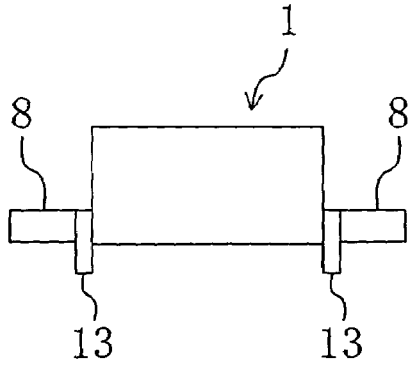
FIG. 7 is a view indicating a case in which light blocking members are provided between unit cases and an ink ejecting portion, as seen from the sub-scanning direction of the ink jet head.

Furthermore, as shown in FIG. 7, it is preferable to provide, between each unit case 8 and the ink ejecting portion 2, a light blocking member 13 for preventing part of the ultraviolet light produced by the ultraviolet light emitting diodes 7 from reaching the ink ejecting portion.

In addition, it is preferable that curing prevention material, which prevents ink attached onto the ink ejecting portion 2 and the ultraviolet light emitting surfaces of the unit cases 8 from curing even under ultraviolet irradiation, be applied onto at least the ink ejecting portion 2 of the recording medium opposing surface and the ultraviolet light emitting surfaces of the unit cases 8.

More specifically, once ink attached onto the ink ejecting portion 2 and the ultraviolet light emitting surfaces of the unit cases 8 has cured, removing the ink becomes difficult, causing clogging of the nozzle holes 3 or decreasing the illumination of ultraviolet light on the recording surface of the recording paper 29. In view of this, by tilting the ultraviolet light emitting surfaces of the unit cases 8 and by providing the light blocking members 13 as described above, ink is less likely to be attached onto the ultraviolet light emitting surfaces of the unit cases 8, and ink attached onto the ink ejecting portion 2 does not cure easily. Moreover, even if ink has been attached onto the ultraviolet light emitting surfaces of the unit cases 8 or ultraviolet light is applied to the ink ejecting portion, the application of the curing prevention material prevents curing of the ink attached onto the ink ejecting portion 2 and the ultraviolet light emitting surfaces of the unit cases 8.

Figure 8:
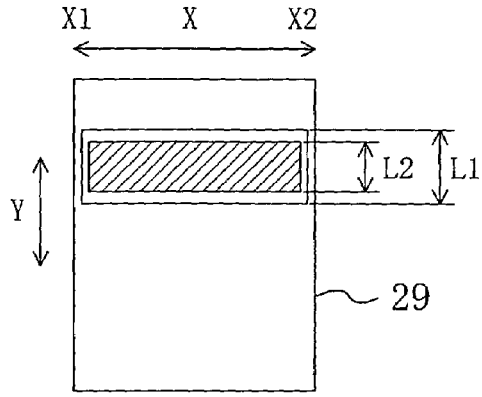
FIG. 8 is a view indicating relationship in terms of size between a portion of the recording surface of a recording paper where recording is performed in a single scanning by an ink jet head and a portion of the recording surface which can be irradiated with ultraviolet light emitted from all ultraviolet light emitting diodes during the single scanning.

The number of ultraviolet light emitting diodes 7 exiting in each ultraviolet-light-emitting-diode row is smaller than the number of nozzle-hole 3 open-ends arranged in each nozzle-hole-open-end row, but is large enough to sufficiently uniformalize the distribution of the illumination of ultraviolet light (i.e., to avoid inconsistencies in density) in a portion of the recording surface of the recording paper 29 where recording is performed in a single scanning by the ink jet head 1, in the ultraviolet-light-emitting-diode-row direction (i.e., the sub-scanning direction.) And in order to ensure that such a portion of the recording surface of the recording paper 29 where recording is performed in a single scanning by the ink jet head 1 is entirely irradiated with ultraviolet light, the ultraviolet light emitting diodes 7 located on both ends of each ultraviolet-light-emitting-diode row are disposed outwardly of the nozzle-hole 3 open-ends located on both ends of each nozzle-hole-open-end row with respect to the direction of the nozzle-hole-open-end row (i.e., the sub-scanning direction.) Alternatively, as shown in FIG. 8, even if they are disposed inwardly with respect to the nozzle-hole-open-end row direction, the length L2, in the ultraviolet-light-emitting-diode row direction, of a part (i.e., the diagonally shaded area in FIG. 8,) of the recording surface of the recording paper 29 where recording is performed in a single scanning by the ink jet head 1 is set smaller than the length L1, in the ultraviolet-light-emitting-diode row direction (i.e., the sub-scanning direction), of a part (i.e., the open rectangular area shown in FIG. 8,) of the recording surface of the recording paper 29 which can be irradiated with ultraviolet light emitted by all of the ultraviolet light emitting diodes 7 during the single scanning.

Figure 9:
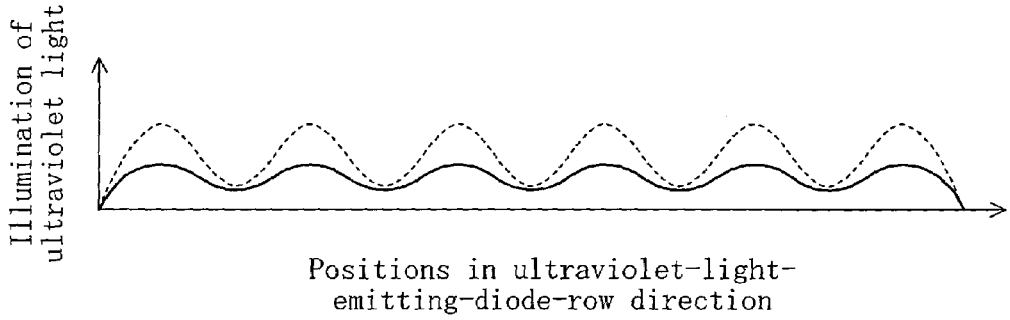
FIG. 9 is a graph indicating relationship between positions in the direction of ultraviolet-light-emitting-diode rows and the illumination of ultraviolet light on the recording surface of a recording paper in cases with and without pattern masks.

In order to further uniformalize, in the ultraviolet-light-emitting-diode row direction (i.e., the sub-scanning direction), the ultraviolet light illumination distribution in the part of the recording surface of the recording paper 29 where recording is performed in a single scanning by the ink jet head 1, a pattern mask may be provided between the ultraviolet light emitting diodes 7 and the recording paper 29 (for example, pattern masks may be provided on the respective ultraviolet light emitting surfaces of the unit cases 8.) The pattern masks reduce difference in ultraviolet light illumination on the recording surface of the recording paper 29 between a portion corresponding to the middle position between any two neighboring ultraviolet light emitting diodes 7 in each ultraviolet-light-emitting-diode row and portions corresponding to the positions of those ultraviolet light emitting diodes 7. As such pattern masks, masks whose ultraviolet light transmittance varies depending upon their thickness or the density of their mesh holes may be used. Specifically, portions of the pattern masks corresponding to the positions of the respective ultraviolet light emitting diodes 7 are designed so as to have a larger thickness or a smaller mesh-hole density than portions thereof corresponding to the middle positions between any neighboring ultraviolet light emitting diodes 7, in order to have a reduced ultraviolet light transmittance. By the use of such pattern masks, the distribution of ultraviolet light illumination on the recording surface of the recording paper 29 is further uniformalized in the ultraviolet-light-emitting-diode row direction, as indicated by the solid line in FIG. 9 (the broken line in FIG. 9 indicates a case without the pattern masks.) It is more preferable that the pattern masks be made of the above-mentioned cure prevention material.

Figure 10:
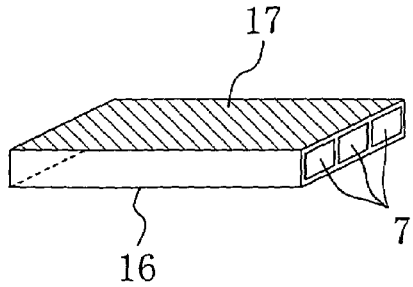
FIG. 10 is an oblique view indicating an exemplary case in which ultraviolet light emitted from ultraviolet light emitting diodes is applied via a light guiding member to ink on a recording paper.

Also, as shown in FIG. 10, if ultraviolet light produced by the ultraviolet light emitting diodes 7 is applied through a light guiding member 16 to ink attached onto the recording paper 29, the ultraviolet light is applied flatly and substantially uniformly from the light guiding member 16, allowing the uniform distribution of the ultraviolet light illumination on the recording surface of the recording paper 29. In FIG. 10, the reference numeral 17 denotes a reflecting plate for permitting the ultraviolet light produced by the ultraviolet light emitting diodes 7 to come out from a surface (i.e., the lower surface in FIG. 10) of the light guiding member.

In the first embodiment, of the unit cases 8 provided at both sides of the ink ejecting portion 2 with respect to the main scanning direction, the ultraviolet light emitting diodes 7 in only one unit case 8 located rearward with respect to the moving direction of the ink jet head 1 emit ultraviolet light. More specifically, when the ink jet head 1 is performing a forward motion (i.e., when it is moving from X1 toward X2), the ultraviolet light emitting diodes 7 in the unit case 8 positioned closer to X1 emit ultraviolet light, while no ultraviolet light is emitted by the ultraviolet light emitting diodes 7 in the unit case 8 located closer to X2. On the other hand, when the ink jet head 1 is performing a backward motion (i.e., when it is moving from X2 to X1), the ultraviolet light emitting diodes 7 in the unit case 8 located closer to X2 emit ultraviolet light, while no ultraviolet light is emitted by the ultraviolet light emitting diodes 7 in the unit case 8 situated closer to X1. It should be noted that the ultraviolet light emitting diodes 7 in the unit cases 8 on both sides may emit ultraviolet light. However, in view of power savings, it is desirable, as described above, that the ultraviolet light emitting diodes 7 in only one of the unit cases 8 which is located rearward with respect to the moving direction of the ink jet head 1 emit ultraviolet light.

By the above configuration, when the ink jet head 1 performs a forward motion, ink is ejected from the nozzle holes 3, while the ultraviolet light emitting diodes 7 in the unit case 8 closer to X1 are put into a light emitting state. Thus, immediately after the ink is ejected from the nozzle holes 3 and attached onto the recording surface of the recording paper 29, the X1-side unit case 8 is located above, and faces, the attached ink and the attached ink is cured by irradiation with ultraviolet light emitted by the ultraviolet light emitting diodes 7 in this unit case 8. The ejection of the ink is completed just before the completion of the forward motion, and when the ink jet head 1 arrives at X2, all of the ink attached to the portion in which the recording has been performed by the forward motion is cured by the ultraviolet irradiation.

When a given amount of time (i.e., the time required for the curing of the ink ejected immediately before the completion of the forward motion) has elapsed after the arrival of the ink jet head 1 at X2, the ultraviolet light emitting diodes 7 are put into a non light-emitting state, while the recording paper 29 is moved toward one side in the sub-scanning direction by a length substantially equal to the length, in the sub-scanning direction, of the part in which the recording has been performed by the forward motion.

Subsequently, the ink jet head 1 is put into a backward motion. During the backward motion, ink is ejected from the nozzle holes 3, while the ultraviolet light emitting diodes 7 in the unit case 8 located closer to X2 are put into a light emitting state. Thus, immediately after the ink is ejected from the nozzle holes 3 and attached onto the recording surface of the recording paper 29, the X2-side unit case 8 is located above, and faces, the attached ink and the attached ink is cured by irradiation with ultraviolet light emitted by the ultraviolet light emitting diodes 7 in this unit case 8. The ejection of the ink is completed just before the completion of the backward motion, and when the ink jet head 1 reaches X1, all of the ink attached to the portion in which the recording has been performed by the backward motion is cured by the ultraviolet irradiation.

When a given amount of time (i.e., the time required for the curing of the ink ejected immediately before the completion of the backward motion) has elapsed after the arrival of the ink jet head 1 at X1, the ultraviolet light emitting diodes 7 are put into a non light-emitting state, while the recording paper 29 is moved further toward the one side in the sub-scanning direction.

Then, the ink jet head 1 is put into a forward motion again. By repeating the above-described motions, recording is performed on the entire recording surface of the recording paper 29.

As described above, in the first embodiment, the ink jet head 1 is provided with the ultraviolet light emitting diodes 7 arranged in the rows in the sub-scanning direction, so that the ultraviolet light emitting diodes 7 cure ink, immediately after the ink has been attached onto the recording surface of the recording paper 29. Thus, unlike cases in which discharge lamps are provided, spreading and bleeding of the ink on the recording surface is prevented by curing the ink, while the distribution of ultraviolet light illumination on the recording surface is uniformalized in the sub-scanning direction to avoid inconsistencies in density, without causing an increase in the size of the ink jet head 1 and a corresponding increase in the size of the recording apparatus. Furthermore, since the ultraviolet light emitting diodes are disposed in vicinity to the recording surface of the recording paper 29, ink on the recording surface is cured to a sufficient degree that spreading and bleeding of the ink does not occur, even if the ultraviolet light emitting diodes 7 whose emission intensity is lower than that of discharge lamps are used. Moreover, the ultraviolet light emitting diodes 7, which have a longer life and better responsiveness than discharge lamps, enhance maintainability. And power savings are also achieved by putting the ultraviolet light emitting diodes 7 into a non light-emitting state when they do not have to emit light, combined with the fact that their power consumption is small.

Although in the first embodiment, ink is ejected from the nozzle holes 3 each time the ink jet head 1 performs a forward motion and a backward motion, ink may be ejected only when the ink jet head 1 performs forward motions. In that case, when a given amount of time has elapsed after the completion of a forward motion of the ink jet head 1, the ultraviolet light emitting diodes 7 are put into a non light-emitting state, while the recording paper 29 is moved toward the one side in the sub-scanning direction, at which time the ink jet head 1 performs the backward motion. When the moving of the recording paper 29 and the backward motion have both been completed, a forward motion such as described above is performed again. In this configuration, the unit case 8 closer to X2 can be removed, so that only the unit case 8 closer to X1 remains. In other words, the ultraviolet light emitting diodes 7 may be provided in a position rearward of the ink ejecting portion 2 with respect to the direction in which the ink jet head 1 moves during its forward motion. This minimizes the number of ultraviolet light emitting diodes 7, thereby reducing costs.

Figure 11:
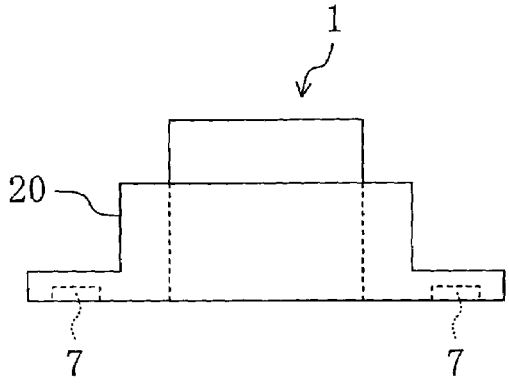
FIG. 11 is a view indicating a case in which ultraviolet light emitting diodes are disposed in a heat conduction member, as seen from the sub-scanning direction of the ink jet head.

Also, although in the first embodiment, the ultraviolet light emitting diodes 7 are disposed on the ink jet head 1, they may be disposed on a moving member which moves together with the ink jet head 1, e.g., the carriage 31 or a member formed on the carriage 31. Furthermore, the ultraviolet light emitting diodes 7 do not necessarily have to be placed in the unit cases 8 or individually placed in cases, but may be mounted onto the nozzle plate which forms the recording medium opposing surface of the ink jet head 1 and in which the nozzle holes 3 are formed, or onto a member other than the nozzle plate. This member may be the moving member discussed above or a heat conduction member 20 shown in FIG. 11 for conducting heat produced by the emission by the ultraviolet light emitting diodes 7 to the ink within the ink jet head 1. The heat conduction member 20, made of metal, is formed to surround portions of the lateral surfaces of the ink jet head 1 which correspond to the portion in the ink jet head 1 in which the ink is placed. The heat conduction member 20 enables the temperature of the ink in the ink jet head 1 to be raised so that the viscosity of the ink is decreased (UV curable inks have higher viscosity than typical inks), thereby improving the ink-ejection capability.

Moreover, in cases where heat generated by the ultraviolet light emitting diodes 7 increases the temperature of the ultraviolet light emitting diodes 7 themselves or the temperature of the ink jet head 1 to an excessively high degree to cause deformation of the nozzle plate or other members, a radiator, e.g., a heat sink or a fan, for dissipating the heat resulting from the emission by the ultraviolet light emitting diodes 7 may be provided. When a fan is employed, a temperature sensor for detecting the temperature of the ultraviolet light emitting diodes 7 or the ink jet head 1 may be provided. When the temperature detected by the temperature sensor exceeds a predetermined temperature, the fan may be operated, while when the temperature falls below the predetermined temperature, the operation of the fan may be stopped.

Figure 12:
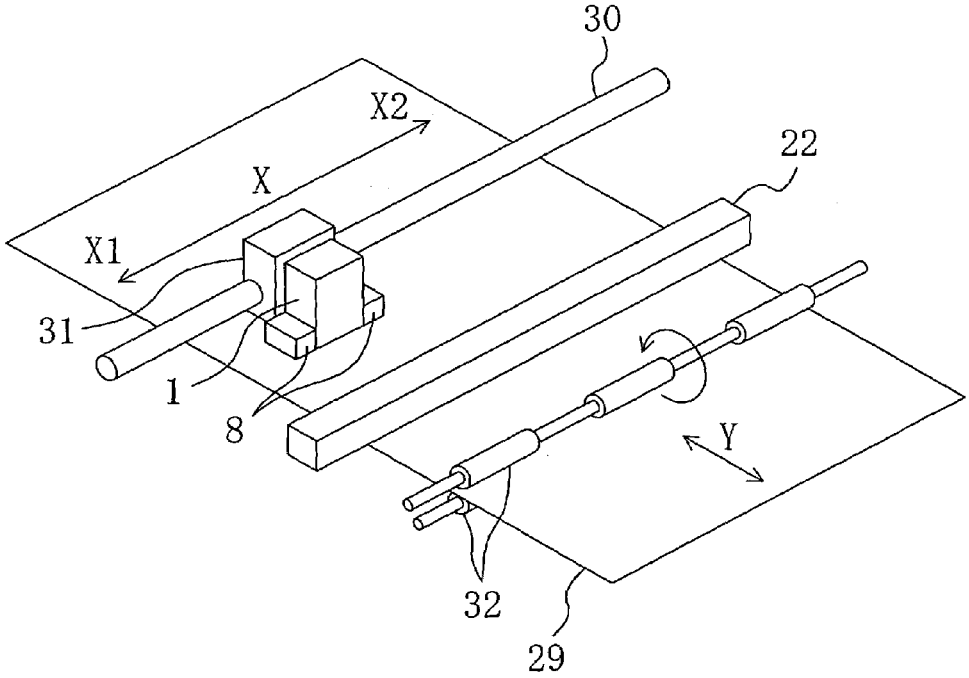
FIG. 12 is a view corresponding to FIG. 1 and indicating a case where a lamp unit for secondary curing is provided.

Furthermore, in the first embodiment, curing of the ink attached onto the recording surface of the recording paper 29 is performed by the ultraviolet light emitting diodes 7 alone. However, as shown in FIG. 12, discharge lamps (in FIG. 12, a lamp unit 22 in which a plurality of discharge lamps are arranged in the main scanning direction), which are capable of applying ultraviolet light to the entire recording area, with respect to the main scanning direction, of the recording surface of the recording paper 29, may be provided in a position ahead of the ink jet head 1 with respect to the moving direction of the recording paper 29. In this case, with the ink jet head 1 being moved, ink is ejected from the nozzle holes 3 of the ink jet head 1 and primary curing of the ink ejected and attached onto the recording surface of the recording paper 29 is performed by the ultraviolet light emitting diodes 7. The recording paper 29 is then moved in the sub-scanning direction parallel to the recording surface of the recording paper 29, and secondary curing of the ink already subjected to the primary curing is performed by the discharge lamps in the lamp unit 22. The secondary curing is performed at the time the ink, already subjected to the primary curing during the previous or earlier single scanning, is moved to a position that opposes the lamp unit 22, as the recording paper 29 is moved upon the completion of the recording performed in that previous single scanning. Alternatively, the secondary curing may be performed, after recording on the entire recording surface of the recording paper 29 has been completed, by moving the recording paper 29 further in the sub-scanning direction to pass the recording paper 29 under the lamp unit 22. In this recording method, all of the ink on the recording surface is reliably cured at the time all of the recording has been completed, even if the ultraviolet light emitting diodes 7 having significantly low emission intensity are used.

Second Embodiment

Figure 13:
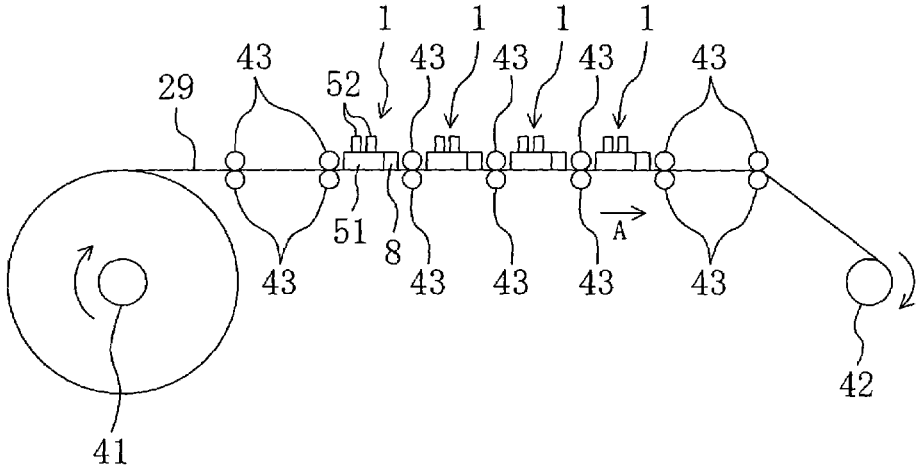
FIG. 13 is a lateral view schematically illustrating an ink jet recording apparatus according to a second embodiment of the present invention.
Figure 14:
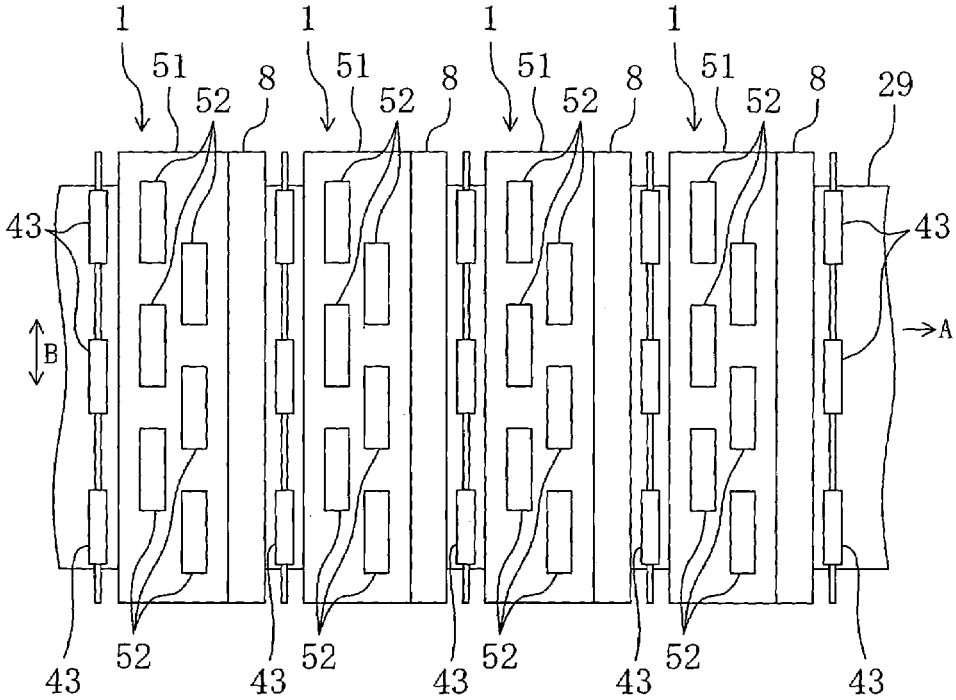
FIG. 14 is a plan view illustrating a recording section of the ink jet recording apparatus according to the second embodiment.

FIGS. 13 and 14 illustrate a second embodiment of the present invention, in which ink jet heads 1 are so-called line heads.

More specifically, in the second embodiment, a recording paper 29, fed from a feeding roller 41 which rotates clockwise as shown in FIG. 13, passes through a recording section, in which four ink jet heads 1 are disposed, and then is rolled up on a take-up roller 42 which rotates clockwise as shown in FIG. 13. The feeding roller 41, the take-up roller 42, and a plurality of guide rollers 43 formed in the recording section move the recording paper 29 substantially horizontally in the recording section in a predetermined direction (which is a direction going toward the take-up roller 42, i.e., the direction A shown in FIGS. 13 and 14) parallel to the recording surface (i.e., the upper surface) of the recording paper 29. In this manner, the feeding roller 41, the take-up roller 42 and the guide rollers 43 form a recording-medium moving mechanism for moving the recording paper 29 in the recording section in the direction parallel to the recording surface of the recording paper 29 toward the take-up roller 42.

The four ink jet heads 1 extend in parallel with the recording surface of the recording paper 29 in the direction (which is the width direction of the recording paper 29, i.e., the direction B shown in FIG. 14) perpendicular to the moving direction of the recording paper 29. The four ink jet heads 1, from the one closest to the feeding roller 41 to the farthest one, respectively, eject yellow, magenta, cyan, and black inks (the same UV curable inks as those of the first embodiment.) In cases where only a single color (black, for example) ink is used, only a single ink jet head 1 may be provided.

Figure 15:
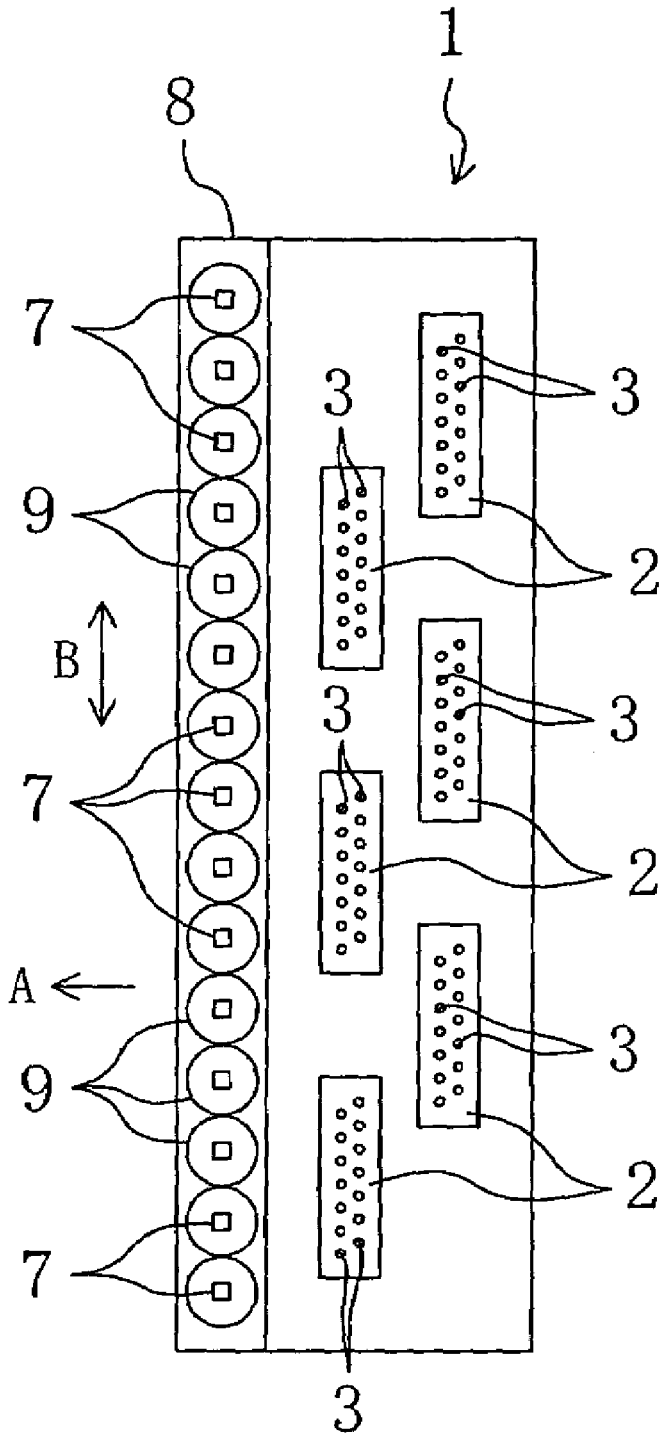
FIG. 15 is the bottom view of an ink jet head of the ink jet recording apparatus of the second embodiment.

Each ink jet head 1 includes a base plate 51 and six nozzle head portions 52. When seen from the direction (i.e., the upward/downward direction) perpendicular with respect to the recording surface of the recording paper 29, the six nozzle head portions 52 are arranged to form two linear rows extending in the length direction of the ink jet head 1. Each nozzle head portion in each nozzle-head-portion row is disposed in a position corresponding to the middle position between two adjacent nozzle head portions 52 arranged in the neighboring nozzle-head-portion row, so that the nozzle head portions 52 in the adjoining two rows form a zigzag pattern. Also, as shown in FIG. 15, ink ejecting portions 2 formed with the open ends of a plurality of nozzle holes 3 for ejecting the UV curable ink are provided in portions of the recording-medium opposing surface (i.e., the lower surface) of each ink jet head 1 which correspond to the respective nozzle head portions 52. In each ink ejecting portion 2, the open ends of the nozzle holes 3 are arranged to form two linear rows extending in the length direction of the ink jet head 1. Each nozzle-hole 3 open-end in each of the two nozzle-hole-open-end rows is disposed in a portion corresponding to the middle position between two adjacent nozzle-hole 3 open-ends arranged in the neighboring nozzle-hole-open-end row, so that the open ends of the nozzle holes 3 in the adjoining nozzle-hole-open-end rows form a zigzag pattern.

All of the nozzle holes 3 of each ink jet head 1 are disposed so that recording can be performed in substantially the entire width direction of the recording paper 29. With the recording paper 29 being moved toward the take-up roller 42, ink is ejected from the nozzle holes 3 of the ink jet heads 1 onto the recording surface of the recording paper 29.

Each ink jet head 1 is provided with a unit case 8 in which ultraviolet light emitting diodes 7 are placed, as in the first embodiment. The unit case 8 is disposed frontward of all of the ink ejecting portions 2 of the ink jet head 1 with respect to the moving direction of the recording paper 29. Specifically, the unit case 8 is disposed on the lateral surface of each ink jet head 1 located closer to the take-up roller 42 (i.e., the lateral surface of the base plate 51 located closer to the take-up roller 42), so that immediately after the ink is ejected from the nozzle holes 3 of the ink jet head 1 and attached onto the recording surface of the recording paper 29, the attached ink is cured by irradiation with ultraviolet light emitted from the ultraviolet light emitting diodes 7 in the unit case 8 formed on that ink jet head 1.

It should be noted that two unit cases 8 may be disposed frontward and rearward of all of the ink ejecting portions 2 of each ink jet head 1, respectively, with respect to the moving direction of the recording paper 29. Especially, by providing the unit cases 8 on both sides of the respective three ink jet heads 1 other than the rearmost ink jet head 1 (which is the ink jet head 1 in the closest vicinity of the feeding roller 41) with respect to the moving direction of the recording paper 29, ink ejected from the nozzle holes 3 of the ink jet head(s) 1 located rearwardly of each of those ink jet heads 1 with respect to the recording paper moving direction and attached onto the recording surface of the recording paper 29 can be cured.

When seen from the direction perpendicular (i.e., the upward/downward direction) with respect to the recording surface of the recording paper 29, the ultraviolet light emitting diodes 7 in each unit case 8 are arranged to form a linear row extending in the length direction of each ink jet head 1. As described in the first embodiment, instead of the single ultraviolet-light-emitting-diode row, a plurality of ultraviolet-light-emitting-diode rows may be provided. In that case, each ultraviolet light emitting diode 7 in each ultraviolet-light-emitting-diode row may be disposed in a position corresponding to the middle position between two adjacent ultraviolet light emitting diodes 7 arranged in a neighboring ultraviolet-light-emitting-diode row, so that the ultraviolet light emitting diodes 7 in the adjoining two rows form a zigzag pattern.

Each unit case 8 is disposed so that its ultraviolet light emitting surface is in the same plane as the recording-medium opposing surface of the corresponding ink jet head 1. Nevertheless, as discussed in the first embodiment, the ultraviolet light emitting surface may be located closer to the recording paper 29 than the recording-medium opposing surface of the ink jet head 1 is, or may be located farther from the recording paper 29 than the recording-medium opposing surface of the ink jet head 1 is. More specifically, the distance between the recording-medium opposing surface of each ink jet head 1 and the recording surface of the recording paper 29 may be from 0.5 mm to 10 mm, while the distance between the ultraviolet light emitting surface of each unit case 8 and the recording surface of the recording paper 29 may be from 0.3 mm to 15 mm.

Moreover, the ultraviolet light emitting surface of each unit case 8 does not have to be parallel, but may be inclined, with respect to the recording surface of the recording paper 29. In that case, the ultraviolet light emitting surface of each unit case 8 may be tilted with respect to the recording medium opposing surface of the corresponding ink jet head 1 so that the side of the ultraviolet light emitting surface closer to the ink ejecting portion 2 is located closer to the recording paper 29 than the opposite side of the unit case 8 is.

Furthermore, it is preferable to provide, between each unit case 8 and the ink ejecting portions 2, a light blocking member for preventing part of ultraviolet light produced by the ultraviolet light emitting diodes 7 from reaching the ink ejecting portions 2.

In addition, curing prevention material, which prevents ink attached onto the ink ejecting portions 2 and the ultraviolet light emitting surfaces of the unit cases 8 from curing even under ultraviolet irradiation, may be applied onto at least the ink ejecting portions 2 of the recording medium opposing surfaces and the ultraviolet light emitting surfaces of the unit cases 8.

In the second embodiment as in the first embodiment, the number of ultraviolet light emitting diodes 7 exiting in each ultraviolet-light-emitting-diode row is large enough to sufficiently uniformalize the distribution of the illumination of ultraviolet light (i.e., to avoid inconsistencies in density) in a portion of the recording surface of the recording paper 29 where recording is performed by the ink jet heads 1, in the ultraviolet-light-emitting-diode-row direction (i.e., the length direction of each ink jet head 1.) And in order to ensure that such a portion of the recording surface of the recording paper 29 where recording is performed by the ink jet heads 1 is entirely irradiated with ultraviolet light with respect to the length directions of the ink jet heads 1, the ultraviolet light emitting diodes 7 located on both ends of each ultraviolet-light-emitting-diode row are disposed outwardly, with respect to the length direction of the ink jet head 1, of the open ends of the nozzle holes 3 located on both ends in the length direction of the ink jet head 1. Alternatively, even if they are disposed inwardly with respect to the length direction of the ink jet head 1, the length, in the ultraviolet-light-emitting-diode row direction, of a portion of the recording surface of the recording paper 29 which can be irradiated with ultraviolet light emitted from all of the ultraviolet light emitting diodes 7 is set longer than the length, in the ultraviolet-light-emitting-diode row direction, of the portion where recording is performed by the ink jet heads.

Also, as mentioned in the first embodiment, pattern masks may be provided between the ultraviolet light emitting diodes 7 and the recording paper 29 (for example, pattern masks may be provided on the ultraviolet light emitting surfaces of the unit cases 8.) The pattern masks reduce difference in ultraviolet light illumination on the recording surface of the recording paper 29 between a portion corresponding to the middle position between any two neighboring ultraviolet light emitting diodes 7 in each ultraviolet-light-emitting-diode row and portions corresponding to the positions of those ultraviolet light emitting diodes 7. Ultraviolet light produced by the ultraviolet light emitting diodes may be applied through a light guiding member to ink attached onto the recording paper 29.

By the above-described configuration, when the recording paper 29 is moving in the recording section toward the take-up roller 42, ink is ejected from the nozzle holes 3, while the ultraviolet light emitting diodes 7 in the unit cases 8 are put into a light emitting state. Thus, immediately after the ink is ejected from the nozzle holes 3 and attached onto the recording surface of the recording paper 29, the attached ink, which is located under the unit cases 8 disposed on the ink jet heads 1, is cured by irradiation with ultraviolet light emitted from the ultraviolet light emitting diodes 7 in those unit cases 8.

As described above, in the second embodiment as in the first embodiment, each ink jet head 1 is provided with the ultraviolet light emitting diodes 7 arranged in the row in the length direction of the ink jet head, so that the ultraviolet light emitting diodes 7 cure ink immediately after the ink has been attached onto the recording surface of the recording paper 29. This prevents increases in the size of the recording apparatus and inconsistencies in density, and in addition, enables improved maintainability and power savings.

Also, although in the second embodiment, the ultraviolet light emitting diodes 7 are disposed on the ink jet heads 1, they may be disposed on fixed members which are provided near the respective ink jet heads 1. Furthermore, the ultraviolet light emitting diodes 7 do not necessarily have to be placed in the unit cases 8 or individually placed in cases, but may be mounted onto the nozzle plates which form the recording medium opposing surfaces of the ink jet heads 1 and in which the nozzle holes 3 are formed, or onto members other than the nozzle plates. These other members may be the fixed members discussed above or the base plates 51 of the respective ink jet heads 1. The base plates 51, if made of metal, serve as heat conduction members for conducting heat produced by the emission by the ultraviolet light emitting diodes 7 to the ink in the ink jet heads 1, as described in the first embodiment.

Moreover, as discussed in the first embodiment, in cases where heat generated by the ultraviolet light emitting diodes 7 increases the temperature of the ultraviolet light emitting diodes 7 themselves or the temperature of the ink jet heads 1 to an excessively high degree to cause deformation of the nozzle plates or other members, a radiator for dissipating the heat resulting from the emission by the ultraviolet light emitting diodes 7 may be provided.

Figure 16:
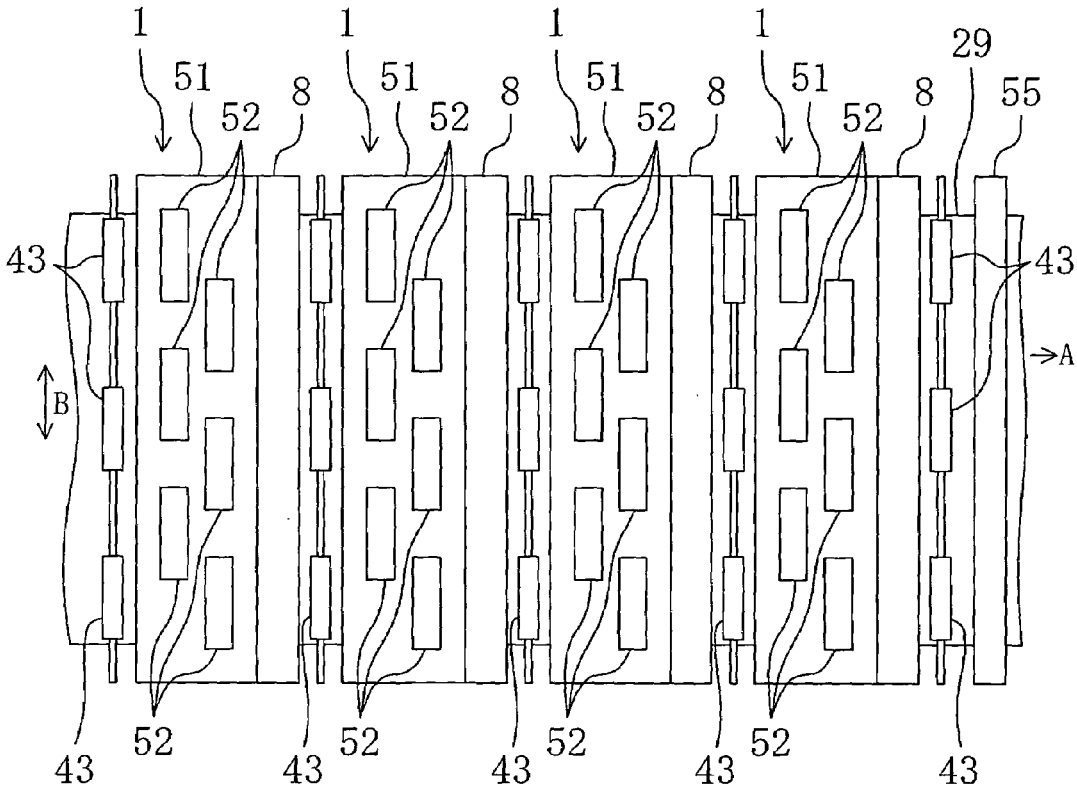
FIG. 16 is a view corresponding to FIG. 14 and indicating a case where a lamp unit for secondary curing is provided.

Also, as discussed in the first embodiment, the ultraviolet light emitting diodes 7 may be used in combination with discharge lamps. More specifically, as shown in FIG. 16, discharge lamps (in FIG. 16, a lamp unit 55 in which a plurality of discharge lamps are arranged in the direction perpendicular to the direction of movement of the recording paper 29), which are capable of applying ultraviolet light to the entire recording area of the recording surface of the recording paper 29 with respect to the direction (the length directions of the ink jet heads 1) perpendicular to the moving direction of the recording paper, may be provided in a position ahead of the forwardmost ink jet head 1 (which is nearest to the take-up roller 42) with respect to the recording paper moving direction. With the recording paper 29 being moved, ink is ejected from the nozzle holes 3 of the ink jet heads 1, and primary curing of the ink ejected and attached onto the recording surface of the recording paper 29 is performed by the ultraviolet light emitting diodes 7 of those ink jet heads 1. Then, secondary curing of the ink already subjected to the primary curing (i.e., the ink ejected from the nozzle holes 3 of all of the ink jet heads 1) is performed by the discharge lamps in the lamp unit 55. It should be noted that lamp units 55 may be provided ahead of the respective ink jet heads 1 with respect to the moving direction of the recording paper 29.

Figure 17:
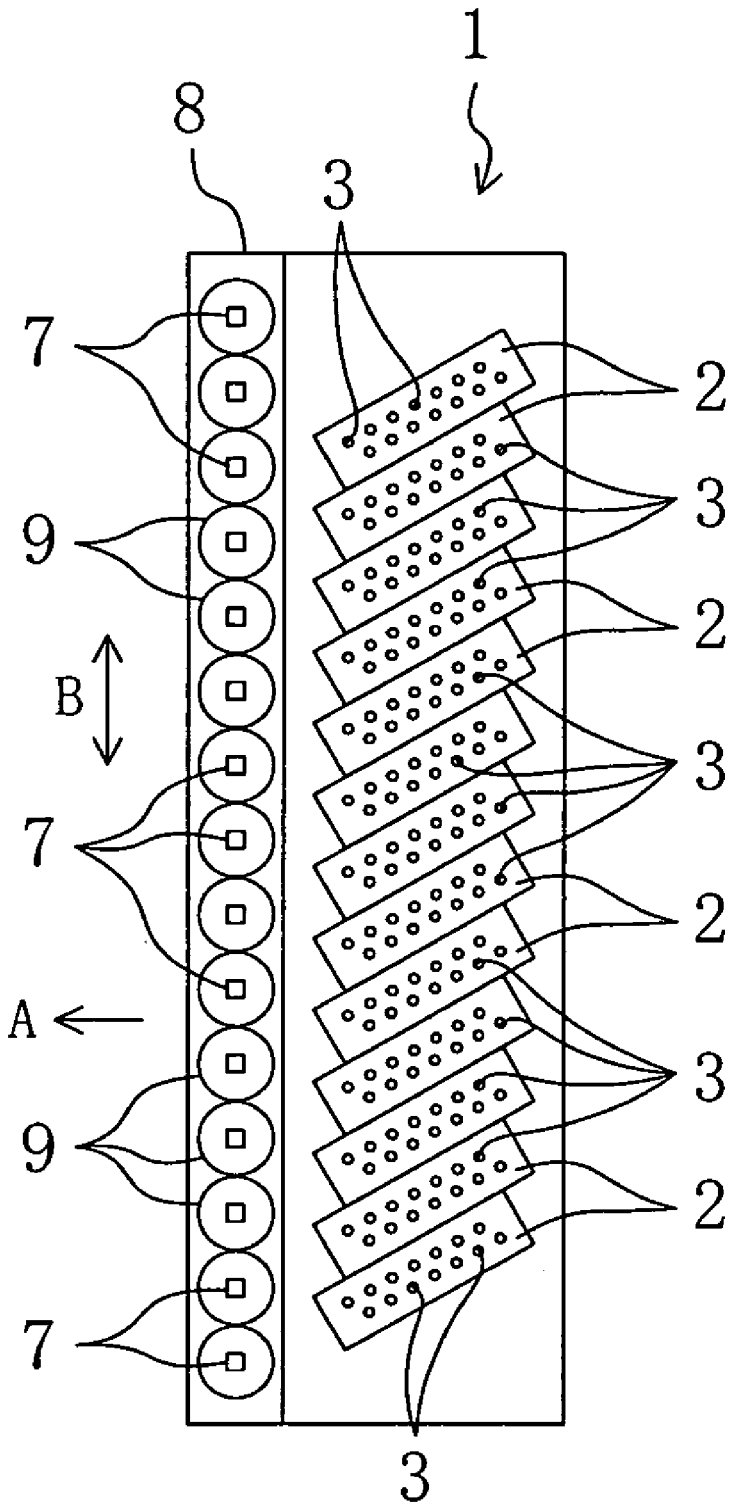
FIG. 17 is a view corresponding to FIG. 15 and illustrating an ink jet head in a different form.

Furthermore, the open ends of the nozzle holes 3 of each ink jet head 1 may be arranged as shown in FIG. 17. More specifically, when seen from the direction perpendicular to the recording surface of the recording paper 29, the nozzle head portions 52 are arranged continuously in the direction perpendicular to the moving direction of the recording paper 29, with each nozzle head portion 52 being oblique with respect to the moving direction of the recording paper 29. And ink ejecting portions 2 having the open ends of the nozzle holes 3 are formed in portions of the recording-medium opposing surface (i.e., the lower surface) of the ink jet head 1 which correspond to the nozzle head portions 52. In each ink ejecting portion 2, the open ends of the nozzle holes 3 are arranged to form two linear rows extending in a direction oblique with respect to the moving direction of the recording paper 29. This arrangement improves recording density on the recording surface of the recording paper 29 in the direction perpendicular to the moving direction of the recording paper 29.

It is obvious that the present invention is not limited to the above-described embodiments, but is susceptible of other embodiments. For example, the inks are not limited to the UV curable inks, but other photocurable inks, which are cured by other light, may be used. In that case, instead of ultraviolet light emitting diodes, a plurality of light emitters which apply light for curing the employed photocurable ink may be used. Those light emitters are desirably light emitting diodes containing GaN.

INDUSTRIAL APPLICABILITY

The present invention is applicable to ink jet recording apparatuses in which a photocurable ink(s) (especially, UV curable ink(s)) is ejected from nozzle holes of an ink jet head(s) and the ink(s) ejected and attached onto the recording surface of a recording medium is cured by irradiation with light (ultraviolet light).

The invention claimed is:

1. An ink jet recording apparatus which includes an ink jet head whose recording-medium opposing surface that opposes a recording surface of a recording medium is furnished with an ink ejecting portion formed with open ends of a plurality of nozzle holes for ejecting a UV curable ink, and a head moving mechanism for putting the ink jet head into reciprocating motion in a predetermined direction parallel to the recording surface of the recording medium, and which performs recording by ejecting the ink from the nozzle holes of the ink jet head onto the recording surface of the recording medium and then curing the ink ejected and attached onto the recording surface of the recording medium by irradiation with ultraviolet light, at least when the head moving mechanism puts the ink jet head into a forward motion of the reciprocating motion, wherein the ink jet head or a moving member which moves together with the ink jet head is provided with a plurality of ultraviolet light emitting diodes for emitting the ultraviolet light to the ink attached onto the recording surface of the recording medium to cure the ink, wherein the ultraviolet light emitting diodes, when seen from a direction perpendicular to the recording surface of the recording medium, are arranged to form one or a plurality of linear rows that extend in a direction perpendicular to the direction of the reciprocating motion of the ink jet head; and wherein the open ends of the nozzle holes are arranged in the ink ejecting portion to form at least one or a plurality of linear rows that extend in a direction perpendicular to the direction of the reciprocating motion of the ink jet head, and the number of the ultraviolet light emitting diodes arranged in each ultraviolet-light-emitting-diode row is smaller than the number of the nozzle hole open ends existing in each nozzle-hole-open-end row.

2. The ink jet recording apparatus of claim 1, wherein each ultraviolet light emitting diode in each ultraviolet-light-emitting-diode row is disposed in a position corresponding to the middle position between two adjacent ultraviolet light emitting diodes arranged in a neighboring one of the ultraviolet-light-emitting-diode rows, so that the ultraviolet light emitting diodes in the two adjoining ultraviolet-light-emitting-diode rows form a zigzag pattern.

3. The ink jet recording apparatus of claim 1, wherein the ultraviolet light emitting diodes existing on both ends of each ultraviolet-light-emitting-diode row are positioned outwardly of the nozzle hole open ends existing on both ends of each nozzle-hole-open-end row with respect to the direction of the nozzle-hole-open-end row.

4. An ink jet recording apparatus which includes an ink jet head whose recording-medium opposing surface that opposes a recording surface of a recording medium is furnished with an ink ejecting portion formed with open ends of a plurality of nozzle holes for ejecting a UV curable ink, and a head moving mechanism for putting the ink jet head into reciprocating motion in a predetermined direction parallel to the recording surface of the recording medium, and which performs recording by ejecting the ink from the nozzle holes of the ink jet head onto the recording surface of the recording medium and then curing the ink ejected and attached onto the recording surface of the recording medium by irradiation with ultraviolet light, at least when the head moving mechanism puts the ink jet head into a forward motion of the reciprocating motion, wherein the ink jet head or a moving member which moves together with the ink jet head is provided with a plurality of ultraviolet light emitting diodes for emitting the ultraviolet light to the ink attached onto the recording surface of the recording medium to cure the ink, wherein the ultraviolet light emitting diodes, when seen from a direction perpendicular to the recording surface of the recording medium, are arranged to form one or a plurality of linear rows that extend in a direction perpendicular to the direction of the reciprocating motion of the ink jet head; and wherein the length, in the direction of the ultraviolet-light-emitting-diode rows, of a portion of the recording surface of the recording medium on which recording is performed in a single forward motion of the ink jet head is smaller than the length, in the direction of the ultraviolet-light-emitting-diode rows, of a portion of the recording surface of the recording medium which can be irradiated with ultraviolet light emitted from all of the ultraviolet light emitting diodes during the single forward motion.

5. The ink jet recording apparatus of claim 4, wherein a pattern mask is provided between the ultraviolet light emitting diodes and the recording medium so as to reduce difference in illumination of ultraviolet light on the recording surface of the recording medium between a portion of the recording surface which corresponds to the middle position between any two adjacent ultraviolet light emitting diodes in each ultraviolet-light-emitting-diode row and portions of the recording surface which correspond to the positions of those two ultraviolet light emitting diodes.

6. An ink jet recording apparatus which includes an ink jet head whose recording-medium opposing surface that opposes a recording surface of a recording medium is furnished with an ink ejecting portion formed with open ends of a plurality of nozzle holes for ejecting a UV curable ink, and a head moving mechanism for putting the ink jet head into reciprocating motion in a predetermined direction parallel to the recording surface of the recording medium, and which performs recording by ejecting the ink from the nozzle holes of the ink jet head onto the recording surface of the recording medium and then curing the ink ejected and attached onto the recording surface of the recording medium by irradiation with ultraviolet light, at least when the head moving mechanism puts the ink jet head into a forward motion of the reciprocating motion, wherein the ink jet head or a moving member which moves together with the ink jet head is provided with a plurality of ultraviolet light emitting diodes for emitting the ultraviolet light to the ink attached onto the recording surface of the recording medium to cure the ink, wherein the apparatus is configured so that the ultraviolet light emitted from the ultraviolet light emitting diodes is applied via a transparent light guiding member to the ink attached to the recording medium, the ultraviolet light emitting diodes being placed in a case, the ultraviolet light being emitted through a surface of the case, the case being disposed at least rearward of the ink ejecting portion with respect to the direction of the forward motion of the ink jet head, and the ultraviolet light emitting surface of the case being tilted with respect to the recording medium opposing surface of the ink jet head so that the side of the ultraviolet light emitting surface closer to the ink ejecting portion is located closer to the recording medium than the opposite side of the case is.

7. An ink jet recording apparatus to perform recording by ejecting an UV curable ink onto a recording surface of a recording medium comprising:

an ink jet head having a recording medium opposing surface that opposes the recording surface of the recording medium, the recording medium opposing surface including a plurality of nozzle holes to eject a UV curable ink on the recording surface of the recording medium;

a carriage configured to put the ink jet head into reciprocating motion in a first direction parallel to the recording surface of the recording medium, the nozzle holes being arranged to form one or a plurality of linear ink holes rows that extend in a second direction perpendicular to the first direction; and a plurality of ultraviolet light emitting diodes configured to emit ultraviolet light to the UV curable ink ejected onto the recording surface of the recording medium to cure the UV curable ink, the ultraviolet light emitting diodes being arranged to form one or a plurality of linear ultraviolet light emitting diode rows that extend in the second direction, wherein the number of the ultraviolet light emitting diodes in each of the linear ultraviolet light emitting diode rows is smaller that the number of nozzle holes in each of the nozzle holes rows.

8. The ink jet apparatus according to claim 7, wherein each ultraviolet emitting diode in each of the linear ultraviolet light emitting diode rows is disposed in a position corresponding to a middle position between two adjacent ultraviolet light emitting diodes arranged in a neighboring one of the plurality of the linear ultraviolet light emitting diode rows, so that the ultraviolet light emitting diodes in the two adjoining linear ultraviolet light emitting diode rows form a zigzag pattern.

9. The ink jet recording apparatus according to claim 7, wherein the ultraviolet light emitting diodes existing on both ends of each of the linear ultraviolet light emitting diode rows are positioned outwardly of the nozzle holes existing on both ends of each of the linear nozzle holes rows with respect to the second direction.

10. An ink jet recording apparatus to perform recording by ejecting an UV curable ink onto a recording surface of a recording medium comprising:

an ink jet head having a recording medium opposing surface that opposes the recording surface of the recording medium, the recording medium opposing surface including a plurality of nozzle holes to eject a UV curable ink on the recording surface of the recording medium;

a carriage configured to put the ink jet head into reciprocating motion in a first direction parallel to the recording surface of the recording medium, the nozzle holes being arranged to form one or a plurality of linear ink holes rows that extend in a second direction perpendicular to the first direction; and a plurality of ultraviolet light emitting diodes configured to emit ultraviolet light to the UV curable ink ejected onto the recording surface of the recording medium to cure the UV curable ink, the ultraviolet light emitting diodes being arranged to form one or a plurality of linear ultraviolet light emitting diode rows that extend in the second direction, wherein a length, in the second direction, of a first area onto which the nozzle holes eject the UV curable ink during a single forward motion of the ink jet head by the carriage is smaller than a length in the second direction, of a second area onto which the ultraviolet light emitting diodes emit the ultraviolet light during the single forward motion.

* * * * *